US010697246B2

(12) United States Patent
Kleuters et al.

(10) Patent No.: US 10,697,246 B2
(45) Date of Patent: Jun. 30, 2020

(54) SHAFT ENLARGEMENT ARRANGEMENT FOR A BORING SYSTEM

(71) Applicant: MASTER SINKERS (PTY) LTD, Fochville, Gauteng (ZA)

(72) Inventors: Nikolaus Kleuters, Geilenkirchen (DE); Daniel Coenraad Pretorius, Fochville (ZA); Barend Jacobus Jordaan, Johannesburg (ZA); Louis Germishuys, Johannesburg (ZA); Nicolaas Bodenstein Goodwin, Fochville (ZA); Gareth Robert Sheppard, Lima (PE)

(73) Assignee: MASTER DRILLING SOUTH AFRICA (PTY) LTD., Fochville (ZA)

( * ) Notice: Subject to any disclaimer, the term of this patent is extended or adjusted under 35 U.S.C. 154(b) by 260 days.

(21) Appl. No.: 15/545,581

(22) PCT Filed: Jan. 25, 2016

(86) PCT No.: PCT/IB2016/050357
§ 371 (c)(1),
(2) Date: Jul. 21, 2017

(87) PCT Pub. No.: WO2016/116910
PCT Pub. Date: Jul. 28, 2016

(65) Prior Publication Data

US 2018/0010392 A1 Jan. 11, 2018

(30) Foreign Application Priority Data

Jan. 23, 2015 (EP) ..... 15152341
Feb. 5, 2015 (ZA) ..... 2015/00851
Jul. 23, 2015 (ZA) ..... 2015/05310

(51) Int. Cl.
*E21B 7/28* (2006.01)
*E21B 27/00* (2006.01)
(Continued)

(52) U.S. Cl.
CPC ..... *E21B 7/28* (2013.01); *E21B 4/16* (2013.01); *E21B 4/18* (2013.01); *E21B 10/32* (2013.01);
(Continued)

(58) Field of Classification Search
CPC .. E21B 10/26; E21D 1/00; E21D 1/06; E21D 9/10; E02D 29/12
(Continued)

(56) References Cited

U.S. PATENT DOCUMENTS 3,379,264 A 4/1968 Cox
3,485,309 A 12/1969 Lawrence
(Continued)

FOREIGN PATENT DOCUMENTS

EP 0050954 A1 5/1982
WO 2016/116910 A1 7/2016

OTHER PUBLICATIONS

International Search Report and Written Opinion issued for International Patent Application No. PCT/IB2016/050357, dated Apr. 1, 2016.
(Continued)

*Primary Examiner* — Giovanna C Wright
*Assistant Examiner* — Dany E Akakpo
(74) *Attorney, Agent, or Firm* — McCarter & English, LLP; David R. Burns

(57) ABSTRACT

A shaft enlargement arrangement for a boring system is provided, the shaft enlargement arrangement comprising a hollow column proximate a lower end of the boring system; a first cutter head that is rotatably fitted to the hollow column, with first drive means being provided to rotate the first cutter head relative to the hollow column so as to bore downwardly a hole having a diameter corresponding substantially to the diameter of the first cutter head; and a boring
(Continued)

head arrangement fitted to an operatively lower end of the column, the boring head arrangement terminating in a second cutter head to bore a leading hole as the boring system proceeds to bore downwardly. In an embodiment, the first cutter head comprises a support body carrying a winged arrangement, the support body being rotatably fitted to the column, the winged arrangement comprising a plurality of wings extending from the support body, each wing being fitted with, or comprising, a plurality of first cutter elements.

20 Claims, 27 Drawing Sheets

(51) Int. Cl.

| | |
|---|---|
| ***E21D 5/04*** | (2006.01) |
| ***E21B 10/32*** | (2006.01) |
| ***E21D 1/08*** | (2006.01) |
| ***E21B 4/16*** | (2006.01) |
| ***E21D 1/06*** | (2006.01) |
| ***E21B 4/18*** | (2006.01) |
| ***E21B 12/06*** | (2006.01) |
| ***E21B 15/00*** | (2006.01) |
| ***E21B 17/10*** | (2006.01) |
| ***E21B 19/00*** | (2006.01) |
| ***E21B 21/00*** | (2006.01) |
| ***E21D 1/03*** | (2006.01) |

(52) U.S. Cl.
CPC ..... *E21B 12/06* (2013.01); *E21B 15/003* (2013.01); *E21B 17/1078* (2013.01); *E21B 19/008* (2013.01); *E21B 21/00* (2013.01); *E21B 27/00* (2013.01); *E21D 1/03* (2013.01); *E21D 1/06* (2013.01); *E21D 1/08* (2013.01); *E21D 5/04* (2013.01)

(58) Field of Classification Search
USPC ..... 405/133, 138
See application file for complete search history.

(56) References Cited

U.S. PATENT DOCUMENTS

| | | | | |
|---|---|---|---|---|
| 3,934,660 | A | 1/1976 | Nelson | |
| 3,965,995 | A | 6/1976 | Sugden | |
| 4,274,675 | A | 6/1981 | Paurat et al. | |
| 4,589,502 | A * | 5/1986 | Salter | E21B 7/003 175/102 |
| 4,732,226 | A | 3/1988 | Ebeling et al. | |
| 5,035,291 | A * | 7/1991 | Shields | E21B 7/124 175/5 |
| 2012/0318581 | A1 | 12/2012 | Webb et al. | |
| 2016/0040482 | A1 | 2/2016 | Loikkanen et al. | |
| 2020/0018163 | A1 | 1/2020 | Jordaan et al. | |

OTHER PUBLICATIONS

International Search Report and Written Opinion for Application No. PCT/IB2017/055734 dated Nov. 21, 2017, 9 pages.

* cited by examiner

SHAFT ENLARGEMENT ARRANGEMENT FOR A BORING SYSTEM

RELATED APPLICATIONS

This application is a 35 U.S.C. § 371 national stage filing of International Application No. PCT/IB2016/050357, filed on Jan. 25, 2016, which claims priority to European Patent Application No. 15152341.2, filed on Jan. 23, 2015, South African Patent Application No. 2015/00851, filed on Feb. 5, 2015, and South African Patent Application No. 2015/05310, filed on Jul. 23, 2015. The entire contents of each of the foregoing applications are incorporated herein by reference.

FIELD OF THE INVENTION

This invention relates to a boring system (or rig or machine), and in particular, in one version, to a blind shaft boring system. In broad terms, the boring system comprises an aboveground support rig arrangement, an intermediate working platforms arrangement and a lowermost shaft enlargement and boring arrangement. The boring system may be used to bore substantially vertical holes or shafts by initiating rock boring at ground level and boring a predetermined distance vertically downwardly. In particular, the present invention may be implemented using either raise boring or blind hole techniques.

BACKGROUND TO THE INVENTION

Conventional raise boring begins with the drilling of a pilot hole vertically down, typically using a directional drilling system. It is drilled using a drilling unit at the surface from which a hollow drill string, comprising a plurality of drill pipes fitted together, extends downwardly. A roller bit to drill the pilot hole is fitted to the lowermost drill pipe of the drill string, with the pipes having a standard thread for high-torque applications. After the pilot hole has broken through to a lower level, the roller bit is removed and replaced with a reamer head comprising a plurality of cutters. The reamer head is rotated and pulled back towards the surface-mounted drilling unit so as to cut a larger hole, or raise, through the ground and rock. The cuttings fall by gravity into a chamber at the bottom of the hole, typically in an uncontrolled manner, where they are removed using a loader.

Blind hole boring, on the other hand, comprises drilling an oversized pilot hole. The oversized pilot hole can be drilled either in a single step, or, more typically, by first drilling an initial 400 mm pilot hole, for example, which is then subsequently enlarged to define a 3 m oversized pilot hole. This process is reasonably well known in the art. A cutting head is then installed above the drilled oversized pilot hole, so that drilling can occur downwardly. The cuttings are then flushed out of the oversized pilot hole. This particular technique is not used that often, as the risk of blocking the pilot hole and creating mud rushes at the bottom of the hole is relatively high.

No known boring system is capable of boring relatively larger holes (preferably having a diameter of between 8 and 15 metres, but possibly even larger), with the cuttings being removable from above the boring system without having to flush out the cuttings, using, for example, reverse circulation.

There are a number of related prior art documents, including published PCT patent application no. WO9320325 which discloses a down reaming apparatus having an upper stabilizer which supports the down reaming apparatus in a bored hole, and a lower stabilizer that provides additional support for the down reaming apparatus.

U.S. Pat. No. 3,965,995 discloses a machine for boring a large diameter blind hole, the machine including a cutterwheel mounted at the lower end of the machine for rotation about a horizontal tubular support. A gripper assembly, positioned above the cutterwheel, secures the machine against the tunnel wall. U.S. Pat. No. 4,646,853 discloses a substantially similar machine.

The prior art documents listed and described above are just a selection of known documents that disclose, to varying degrees, the broad concept of down reaming. However, they all tend to suffer from the following disadvantages:

1. None of them disclose easily implementable arrangements for removing the reamed cuttings from above the reaming apparatus i.e. so that the cuttings exit out of the top of the bored hole.
2. None of them disclose a gripping arrangement that would enable the relatively larger holes (with diameters of between 8 and 15 metres) to be safely, efficiently and economically drilled.
3. None of them disclose a scalable apparatus, to enable a single reaming or boring apparatus to be modified to bore shafts of varying diameters.
4. None of them disclose the ability to bore through hard rock, which presents particular difficulties. At the moment, hard rock boring involves using a blast and advance sequence, which the present invention specifically aims to avoid.

It is an aim of the present invention to provide a boring system or rig to address the above shortcomings prevalent in existing boring arrangements. In an embodiment, the aim is to provide a blind shaft boring system that can achieve very accurate directional drilling and avoid having to drill an initial pilot hole, as is conventionally done.

SUMMARY OF THE INVENTION

According to the invention there is provided a shaft enlargement arrangement for a boring system, the shaft enlargement arrangement comprising:

- a hollow column proximate a lower end of the boring system;
- a first cutter head that is rotatably fitted to the hollow column, with first drive means being provided to rotate the first cutter head relative to the hollow column so as to bore downwardly a hole having a diameter corresponding substantially to the diameter of the first cutter head; and
- a boring head arrangement fitted to an operatively lower end of the column, the boring head arrangement terminating in a second cutter head to bore a leading hole as the boring system proceeds to bore downwardly.

In an embodiment, the first cutter head comprises a support body carrying a winged arrangement, the support body being rotatably fitted to the column, the winged arrangement comprising a plurality of wings extending from the support body, each wing being fitted with, or comprising, a plurality of first cutter elements.

In an embodiment, a gearing housing is mounted above the first cutter head, with first drive means being fitted atop the gearing housing and arranged to drive a gearing arrangement within the gearing housing, which in turn is arranged to rotate the support body and first cutter head around the column. Typically, the first drive means comprises a plurality of electric motors arranged around the periphery of the gearing housing.

Typically, each wing is angled upwardly and away from the support body, so to define a substantially V-shaped cutting profile.

In an embodiment, each wing includes a base wing portion and a movable end wing portion that is movable relative to the base wing portion, with a first actuator being operable to move the end wing portion relative to the base wing portion. In an embodiment, the end wing portion can be moved between an extended position in which the end wing portion extends substantially in line with the base wing portion, and a retracted position in which the end wing portion is moved upwardly relative to the base wing portion, to ultimately facilitate removal of the shaft enlargement arrangement from the bored hole.

In an embodiment, additional wing portions may be fitted between the base wing portion and the end wing portion, to enable the length of the wings to be varied, thereby allowing relatively bigger holes to be bored by increasing the overall diameter of the winged arrangement.

In an embodiment, a lower collecting bunker is provided below the first cutter head, into which cuttings (and dry muck) produced by the rotating first cutter head can be collected. The lower collecting bunker includes a bunker body defining an inlet chute opening to receive the cuttings, and an outlet chute exit that is line with a corresponding aperture defined in the column, through which the cuttings can exit the bunker into the column, for subsequent collection by an inner kibble travelling up and down the column.

Typically, the shaft enlargement arrangement includes a pair of diametrically opposed lower collecting bunkers, with the lowermost portions of the winged arrangement including scrapers to scrape the cuttings into the collecting bunkers as the first cutter head rotates relative to the column.

In an embodiment, the shaft enlargement arrangement includes a gripper arrangement fitted to the hollow column (and is arranged around the column, so as to substantially enclose the column), the gripper arrangement being positioned, in use, below the lower collecting bunker and above the boring head arrangement, the gripper arrangement being arranged to securely grip against the leading hole bored by the second cutter head, so as to secure the boring system in position within the bored hole.

In an embodiment, the gripper arrangement includes a pair of diametrically opposed clamps that extend sidewardly away from the hollow column, the clamps being movable between a retracted, disengaged position and an extended, engaged position in which the clamps clamp against the leading hole defined by the second cutter head, to facilitate and/or control rotation of the first cutter head.

In an embodiment, the gripper arrangement is fitted to a third actuator arrangement that is secured to the column, the third actuator arrangement being operable to move the gripper arrangement axially along the length of the column.

In an embodiment, a stabilizing arrangement is provided to assist the gripper arrangement by first centering the shaft enlargement arrangement, the stabilizing arrangement including a plurality of radially spaced upper stabilizing shields above the gripper arrangement and a pair of radially spaced lower stabilizing shields below the gripper arrangement.

In an embodiment, a protective shield arrangement extends from below the first cutter head, adjacent the lower collecting bunker, to the end of the boring head arrangement, the protective shield arrangement defining windows or apertures to accommodate (and thus allow the operation of) the clamps of the gripper arrangement, and the upper and lower stabilizing shields of the stabilizing arrangement.

In an embodiment, the boring head arrangement is fitted to a flange secured to the operatively lower end of the column, with a boring head being fitted to the flange with a sixth actuator arrangement, the sixth actuator arrangement being operable to extend and retract the boring head relative to the flange, thus facilitating the boring of the leading hole as the boring system proceeds to bore downwardly.

In one version, for boring through hard rock, the boring head comprises a slurry boring head terminating in an operatively flat face to define a slurry shield, the flat face being fitted with a second cutter head to bore the leading hole as the boring system progresses downwardly.

In an embodiment, the slurry boring head is filled with water slurry to apply hydrostatic pressure to the excavation face, with a pump being provided to pump the resulting muck into a separation plant.

In one version, for boring through relatively soft ground, the boring head comprises an EPB (Earth Pressure Balance) head with a cutter head.

In an embodiment, the second cutter head is fitted with, or includes, a plurality of second cutter elements, with second drive means being fitted atop the boring head to drive the second cutter elements of the boring head. Typically, the drive means comprises a plurality of electric motors that extend into the gap between the boring head arrangement and the flange.

In an embodiment, the boring system includes a shaft lining stage comprising a circular shaft lining platform having an inner collar that loosely accommodates the column, with a plurality of cylinders extending between a lower face of the platform and the gearing housing to regulate and control the relative distance between the platform and the gearing housing.

In an embodiment, the shaft lining stage includes a shaft lining system for installing precast concrete lining segments to the inside wall of the bored hole as the boring system progresses downwardly, the shaft lining system comprising:

- a lining segment carrier device to lower lining segments into the bored hole; and
- a segment fitting arm to retrieve the lining segments from the lining segment carrier device and to place them against the side wall of the hole.

In an embodiment, the lining segment carrier device is part of an outer kibble, so that as the outer kibble is lowered into the shaft, a lining segment is simultaneously lowered into the shaft. In an embodiment, the outer kibble passes through apertures defined in superjacent circular platforms, with the shaft lining platform of the shaft lining stage also defining an aperture to allow the outer kibble to progress further downwardly towards the first cutter head. In an embodiment, each circular platform defines a pair of diametrically opposed apertures. In an embodiment, the circular shaft lining platform of the shaft lining stage has a larger diameter than the superjacent platforms, with difference in diameters being sufficient to accommodate the thickness of the concrete lining segments being fitted to the inside wall of the bored hole.

In an embodiment, the shaft lining platform of the shaft lining stage is surrounded by a shield that extends transverse to the shaft lining platform so as to abut against the inside wall of the bored hole, the shield being releasably securable to the shaft lining platform by a securing arrangement.

In an embodiment, the securing arrangement comprises a plurality of radially extending channels defined in the shaft lining platform, each channel including a movable arm that can move between a retracted, disengaged position, in which the shield is disengaged from the shaft lining platform, and an extended, engaged position, in which the arm protrudes from the channel to engage a securing aperture defined in the shield so as temporarily secure the shield relative to the shaft lining platform.

In an embodiment, a plurality of retractable actuating cylinders are provided around the platform, adjacent the shield to support the lining segments as they are placed against the side wall of the shaft, so that the shield is temporarily positioned between the segments and the side wall.

In an embodiment, the shield is provided with steel brushes that capture grout as the grout is pumped into the gap between the lining segments and the side wall, thereby reducing wastage of grout. In addition, the shield comprises a plurality of shield segments that can be displayed radially as the lining segments are pressed against the upper portion of the shield segments during installation, to enable the shield segments to be pressed up right against the wall. In an embodiment, the vertical edges of adjacent shield segments overlap each other, and have a stepped arrangement, so as to also prevent seepage of grout through the shield.

In an embodiment, the segment fitting arm extends from a hydraulic cylinder mounted on or proximate the shaft lining platform, and is arranged to move between various retracted and extended positions to retrieve the lining segments from the lining segment carrier device and to secure them against the side wall of the shaft. The segment fitting arm can also move up and down and be rotated to facilitate the gripping, maneuvering and placement of the lining segments.

In an embodiment, the lining segments comprise a plurality of curved primary lining segments, a pair of end lining segments and a locking lining segment for insertion between the pair of end lining segments, to define a ring of lining segments.

In an embodiment, the primary lining segments are curved to ultimately define a ring of lining segments to line or clad a circular shaft. The primary lining segment comprises a substantially rectangular body having a curved inner face and a correspondingly curved outer face arranged to abut against the side wall of the shaft.

In an embodiment, each end lining segment has a straight edge to abut against a straight edge of a corresponding primary lining segment, and an opposed angled or tapered edge. The end lining segments thus define a trapezoidal space with tapered edges, with the locking lining segment having corresponding tapered edges so that upon insertion between the pair of end lining segments, the locking lining segment defining a key to lock the ring of lining segments together.

In an embodiment, twelve primary lining segments, two end lining segments and a locking lining segment may be used to fully line a circumferential ring of the shaft.

In an embodiment, an upper collecting platform is provided above the shaft lining stage, above which an upper collecting bunker is provided, into which cuttings being lifted by the inner kibble from the lower collecting bunker, the kibble having moved up the column, can be transferred for subsequent collection by the outer kibble, which can then be subsequently lifted through the apertures defined in the superjacent platforms up to surface. The upper collecting bunker includes a bunker body defining an inlet chute opening to receive the cuttings from the inner kibble, and an outlet chute exit, on the outside of the column, that is line with an outer kibble on the upper collecting platform, for subsequent collection.

Typically, a pair of diametrically opposed upper collecting bunkers is provided, to deposit the cuttings into a pair of diametrically opposed outer kibbles.

In an embodiment, the boring system includes an aboveground support rig arrangement comprising a primary overhead crane assembly, a surface rig and a work table, at least one kibble winder to move the outer kibbles up and down the shaft and at least one stage winder to move a service riding platform up and down an upper portion of the column.

A secondary overhead crane assembly, which is separate from the primary overhead crane assembly, is also provided, to assist in preparing the site and moving various pieces of equipment on surface.

In an embodiment, a second tipping arrangement is provided to tip the outer kibbles, once they have been lifted above the surface rig, into adjacent chutes, which guide the contents of the kibbles into collection bays on either side of the support rig arrangement, for subsequent removal by suitable machinery.

In an embodiment, each of the overhead cranes, the surface rig and the work table are arranged to travel on tracks fitted on surface to facilitate the setting up on site of the boring system.

BRIEF DESCRIPTION OF THE DRAWINGS

These and other features of the present invention will be evident when considered in light of the following specification and drawings in which.

DETAILED DESCRIPTION OF THE DRAWINGS

Figure 1:
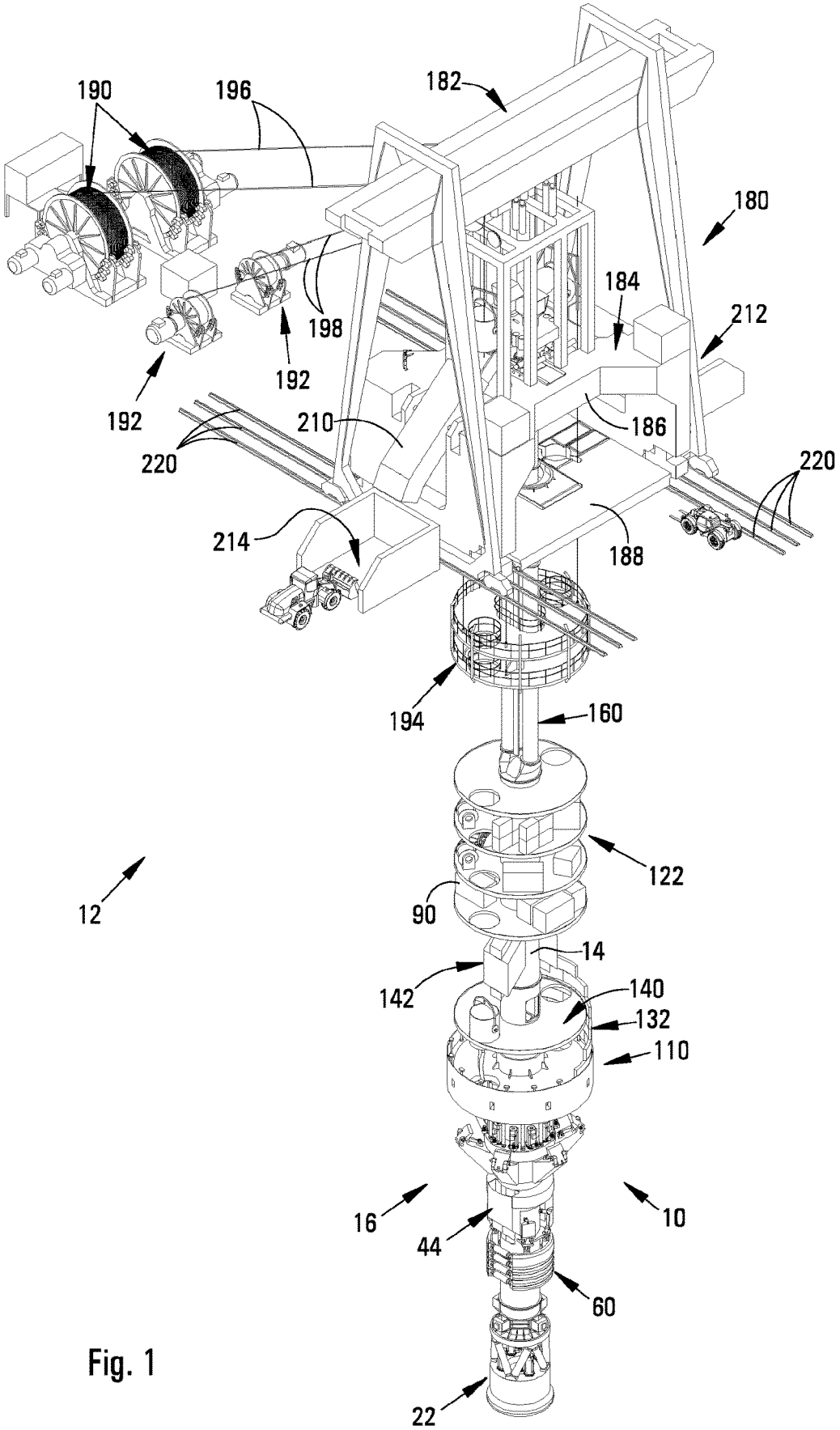
FIG. 1 shows a perspective view of a blind shaft boring system, according to the present invention.

Referring to the figures, and in particular to FIGS. 1, 2, 16, 17 and 18, according to the invention there is provided a shaft enlargement arrangement 10 for a blind shaft boring system 12. Focusing initially on FIGS. 16, 17 and 18, in broad terms, the shaft enlargement arrangement 10 comprises a hollow column 14 proximate a lower end of the boring system 12. The system 10 further includes a first cutter head 16 that is rotatably fitted to the hollow column 14, with first drive means 18 being provided to rotate the first cutter head 16 relative to the hollow column 14 so as to ream downwardly a hole 20 (best shown in FIGS. 19, 20, 21, 26, 27 and 28) having a diameter corresponding substantially to the diameter of the first cutter head 16. The system 10 further includes a boring head arrangement 22 fitted to an operatively lower end of the column 14, the boring head arrangement 22 terminating in a second cutter head 24 to bore a leading hole 26 (i.e. a pilot bore) as the boring system 12 proceeds to bore downwardly.

Turning now to FIGS. 10, 11, 12, 13, 16, 17 and 18, the first cutter head 16 comprises a support body 28 carrying a winged arrangement 30, the support body 28 being rotatably fitted to the outside of the hollow column 14, so that the support body 28 and the winged arrangement 30 can rotate relative to the column 14. The winged arrangement 30 comprises a plurality of wings 32 extending from the support body 28, each wing 32 being fitted with, or comprising, a plurality of first cutter elements (not expressly shown, but these would be fitted to the bottom face of each wing 32).

In an embodiment, a gearing housing 34 is mounted above the first cutter head 16, with the first drive means 18 being fitted atop the gearing housing 34 and being arranged to drive a gearing arrangement within the gearing housing 34, which in turn is arranged to rotate the support body 28 and first cutter head 16 around the column 14. Typically, the first drive means 18 comprises a plurality of electric motors 38 arranged around the periphery of the gearing housing 34.

Typically, each wing 32 is angled upwardly and away from the support body, so to define a substantially V-shaped cutting profile, as best show in FIGS. 17, 18, 19, 20 and 21. Advantageously, the V-shape of the first cutter head 16 allows undercutting by simply adjusting the angle of the first cutter elements on the first cutter head 16.

Figure 10:
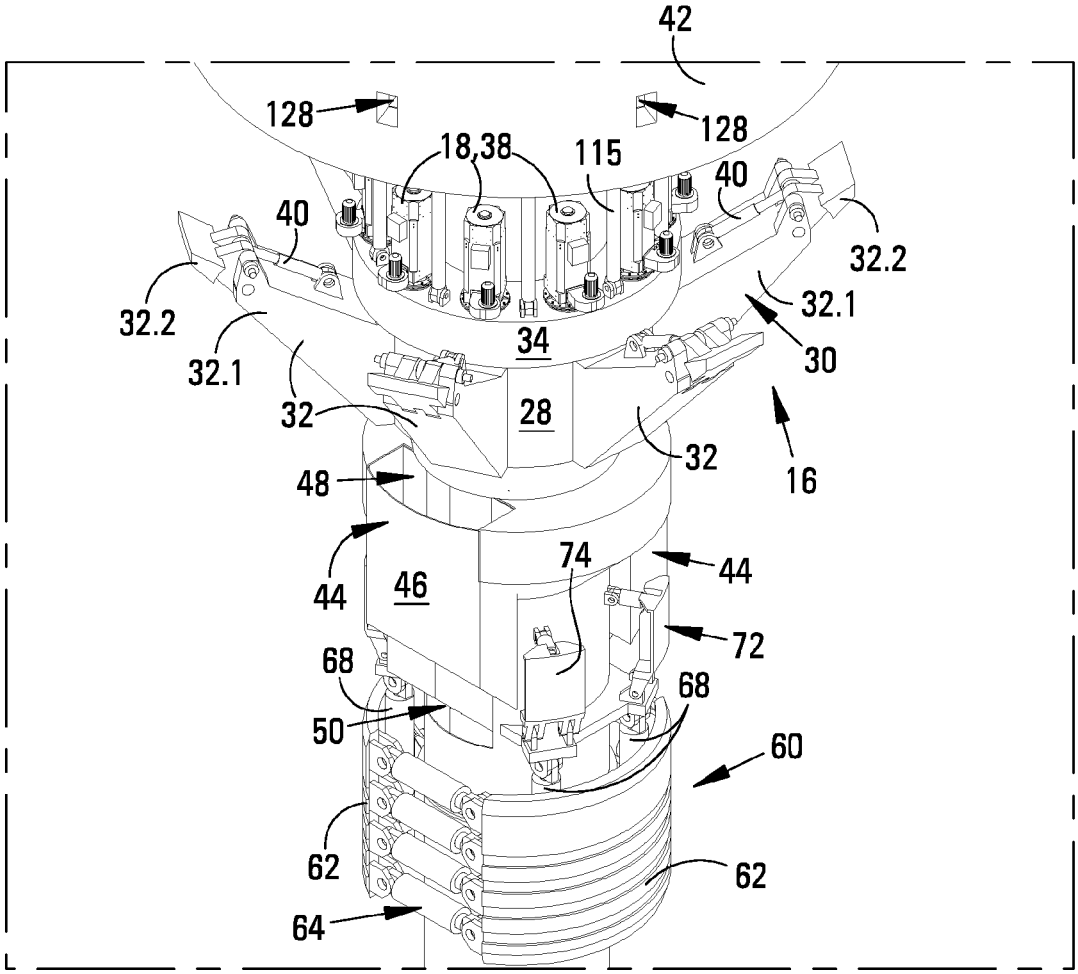
FIG. 10 shows a perspective view of a first cutter head, a lower collecting bunker and a gripper arrangement, all used in the boring system shown in FIGS. 1 and 2.
Figure 11:
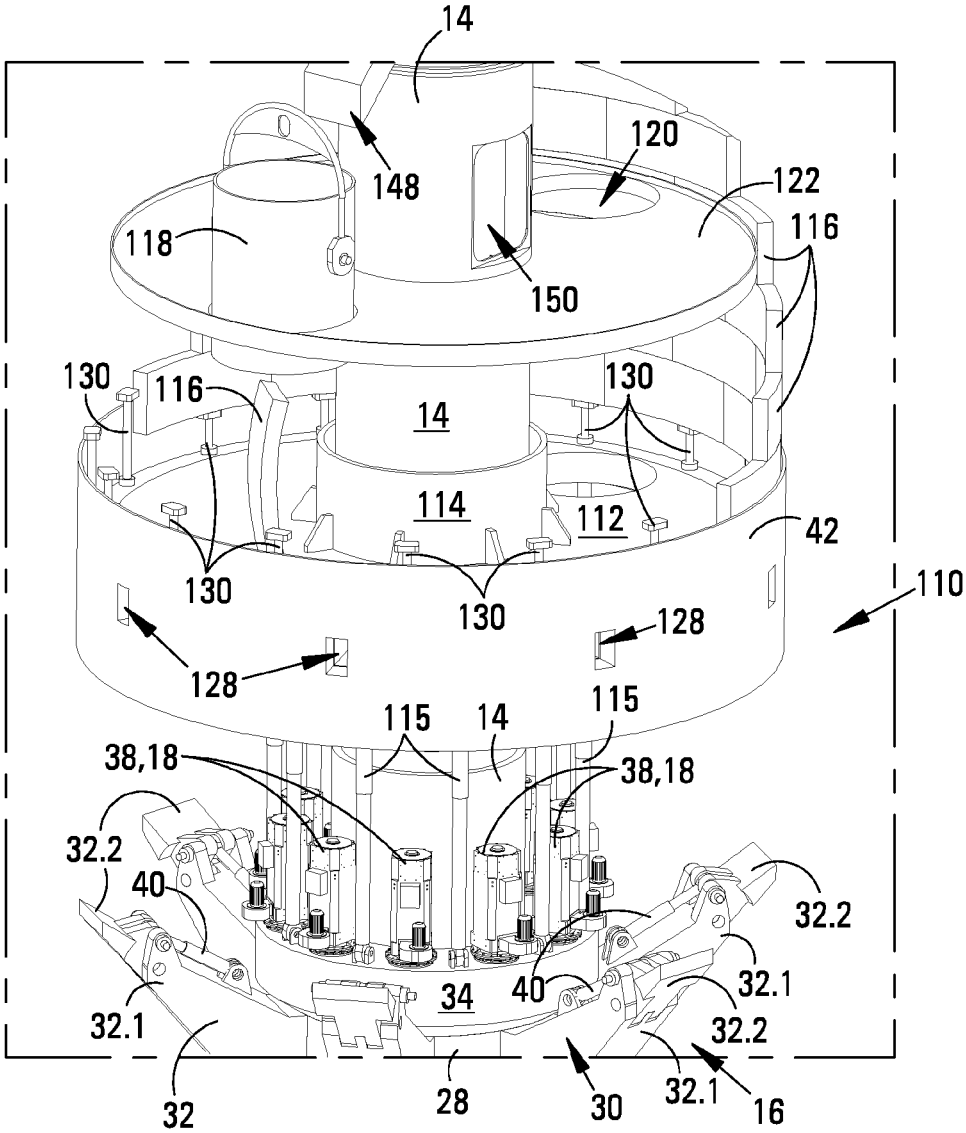
FIG. 11 shows a perspective view of the shaft lining stage in use, as shown in FIGS. 1, 2 and 8.
Figure 12:
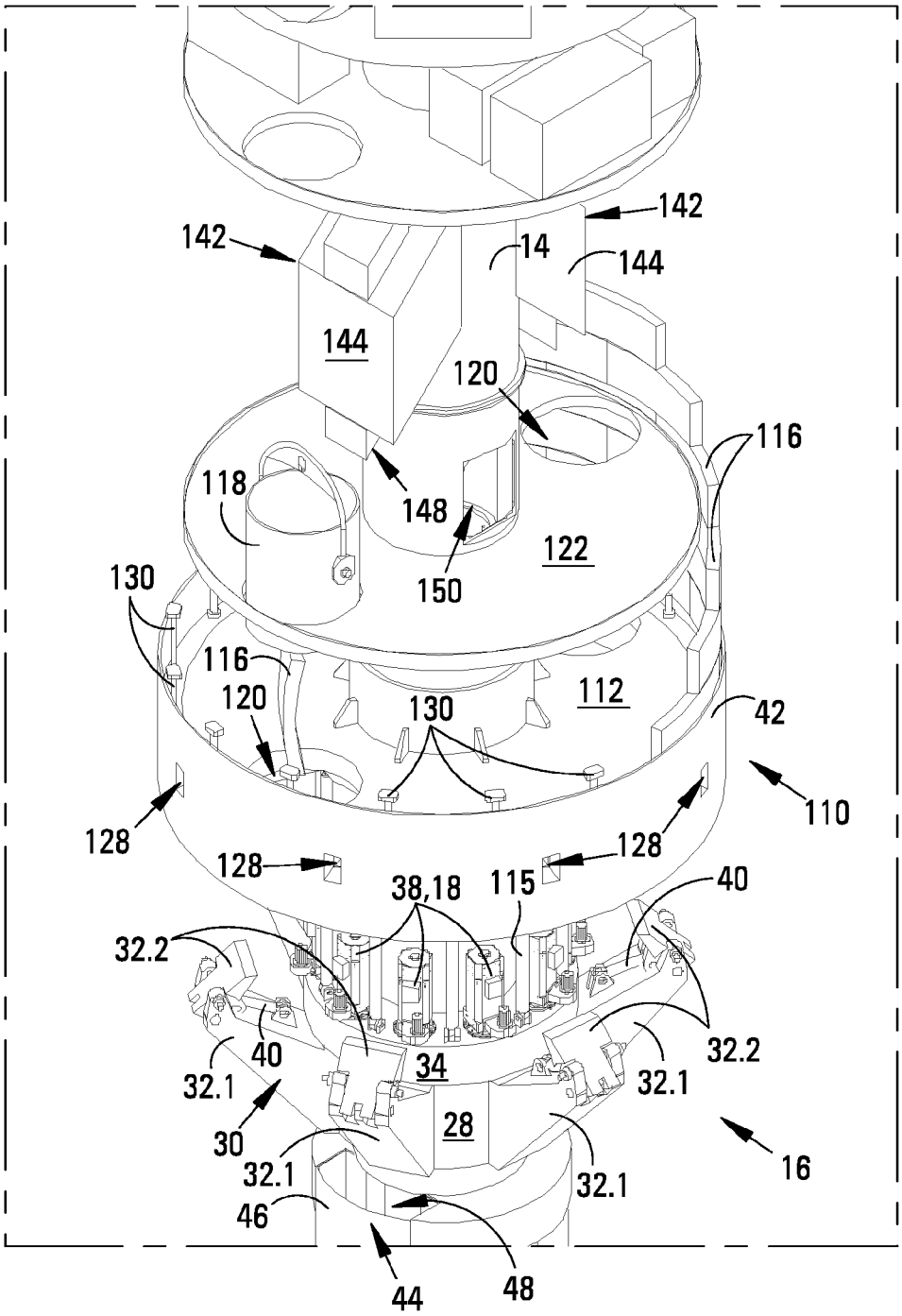
FIG. 12 shows a perspective view of the shaft lining stage in use, as well as the superjacent working platforms and the first cutter head, the first cutter head comprising a winged arrangement comprising a plurality of wings, each wing including a base wing portion and a movable end wing portion that is movable relative to the base wing portion, with the end wing portion in this figure being shown in a retracted position (as opposed to the extended position shown in FIGS. 10 and 11)
Figure 13:
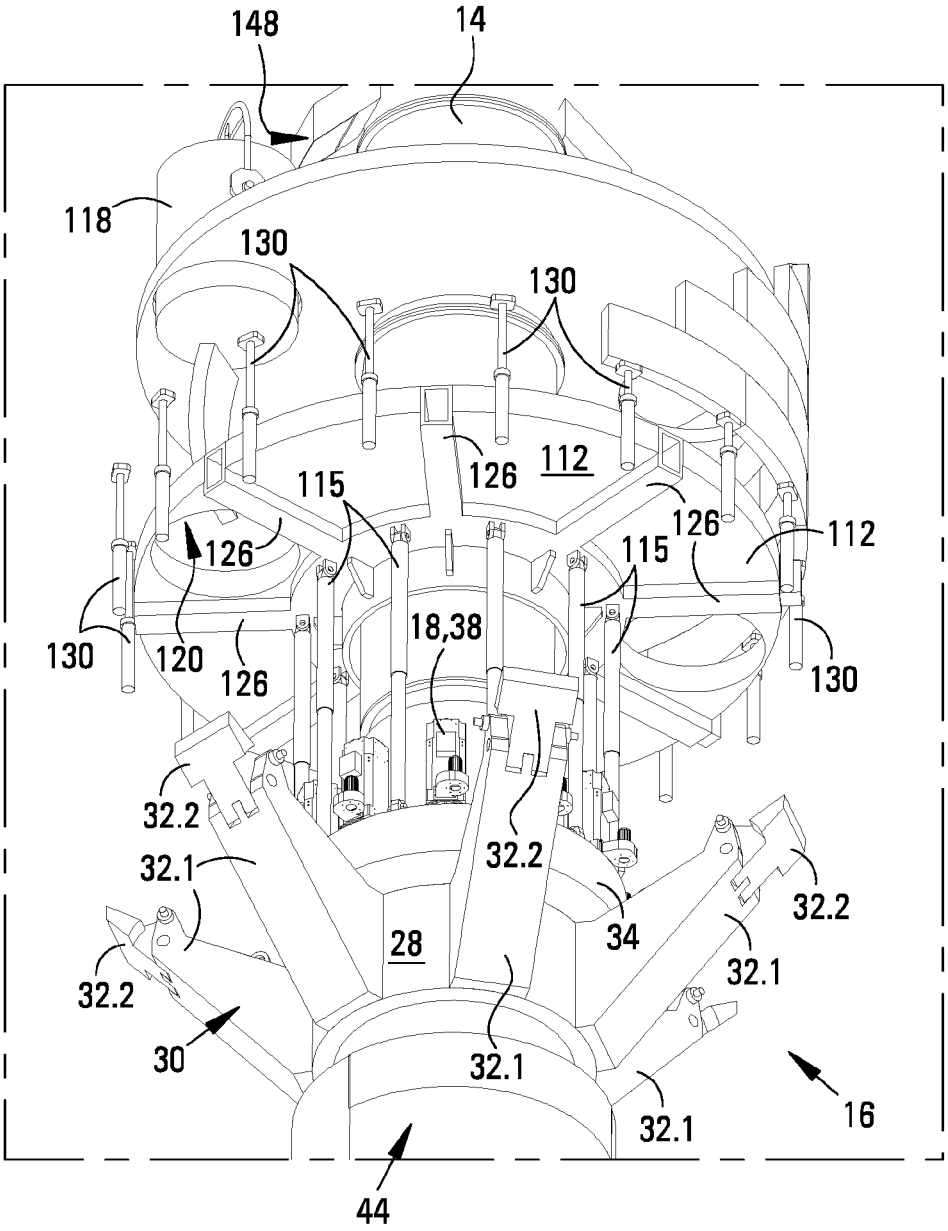
FIG. 13 shows a lower perspective view of the first cutter head and the shaft lining stage in use (save that an enclosing shield around the shaft lining stage has been removed)

Referring back to FIG. 10 in particular, each wing 32 includes a base wing portion 32.1 and a movable end wing portion 32.2 that is movable relative to the base wing portion 32.1, with a first actuator 40 being operable to move the end wing portion 32.2 relative to the base wing portion 32.1. In an embodiment, the end wing portion 32.2 can be moved between an extended position in which the end wing portion extends substantially in line with the base wing portion, as shown in FIGS. 10, 11 and 13, and a retracted position, as shown in FIG. 12, in which the end wing portions 32.2 are moved upwardly relative to the base wing portions 32.1, to ultimately facilitate removal of the shaft enlargement arrangement 10 from the bored hole 20.

In an embodiment, additional wing portions may be fitted between the base wing portion 32.1 and the end wing portion 32.2, to enable the length of the wings 32 to be varied, thereby allowing relatively bigger holes 20 to be bored by increasing the overall diameter of the winged arrangement 30. The diameter of the winged arrangement 30 determines the diameter of the hole 20 to be bored. Thus, only the winged arrangement 30 (and a shaft lining shield 42, which is described in more detail further below) needs to be changed if the desired hole diameter is to change, with the remaining components of the boring system 12 not having to change since they can accommodate the full range of expected hole 20/winged arrangement 30 diameters.

Figure 18:
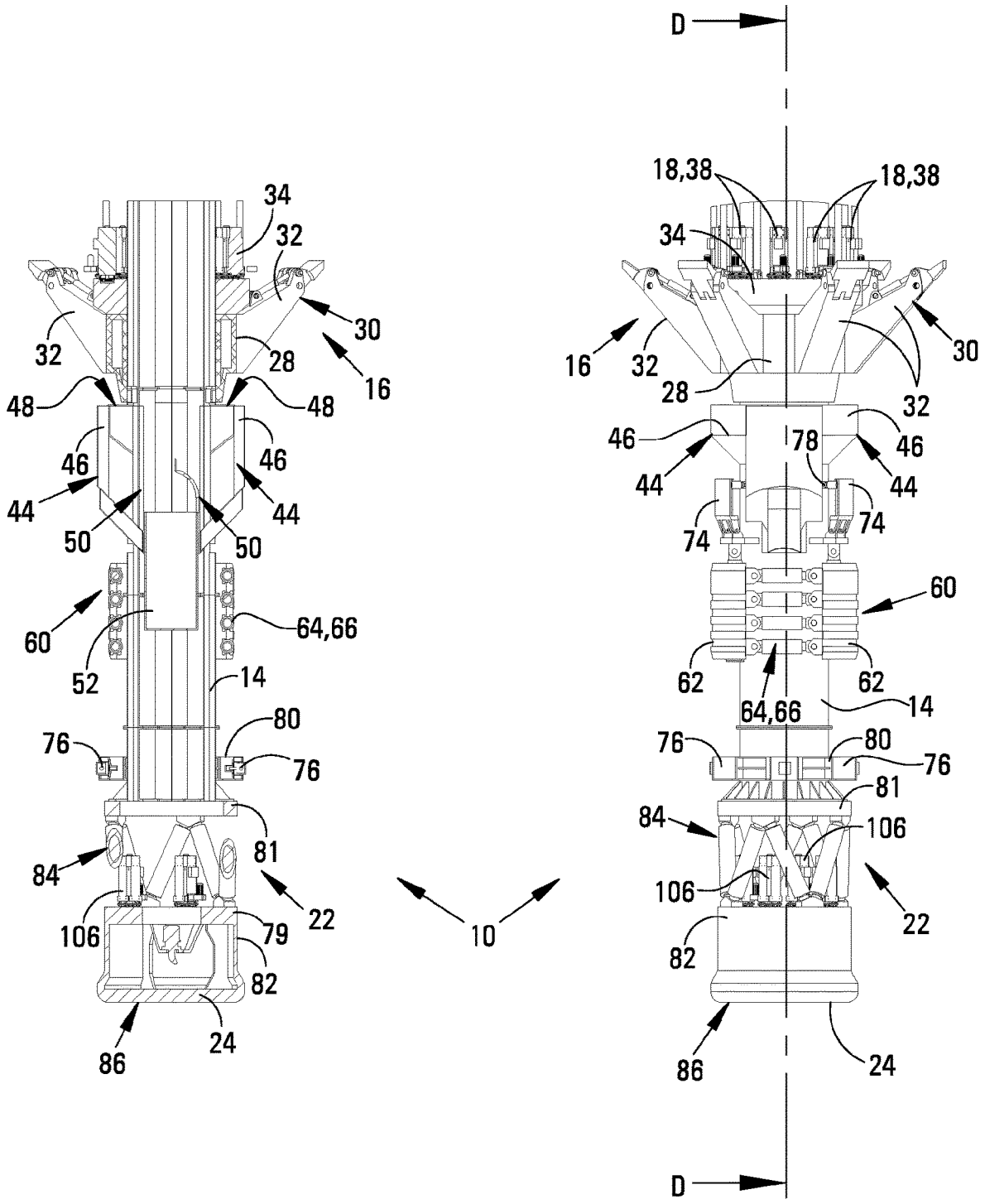
FIG. 18 shows a second side view of the portion of the boring system shown in FIG. 16, and a corresponding cross-sectional end view taken along line D-D.

Still with reference to FIG. 10, in particular, a lower collecting bunker 44 is provided below the first cutter head 16, into which cuttings (and dry muck) produced by the rotating first cutter head 16 can be collected. The lower collecting bunker 44 includes a bunker body 46 defining an inlet chute opening 48 to receive the cuttings, and an outlet chute exit 50 (as best shown in FIG. 18) that is in line with a corresponding aperture defined in the column 14. The cuttings can thus exit the bunker 44 into the column 14, for subsequent collection by an inner kibble 52 travelling up and down the column 14. Typically, the shaft enlargement arrangement 10 includes a pair of diametrically opposed lower collecting bunkers 44, with the lowermost portions of the winged arrangement 30 including scrapers to scrape the cuttings into the collecting bunkers 44 as the first cutter head 16 rotates relative to the column 14.

As best shown in FIGS. 10, 16, 17 and 18, the shaft enlargement arrangement 10 includes a gripper arrangement 60 fitted to the hollow column 14, the gripper arrangement 60 being arranged around the column 14, so as to substantially enclose the column 14. The gripper arrangement 60 is positioned, in use, below the lower collecting bunker 44 and above the boring head arrangement 22, the gripper arrangement 60 being arranged to securely grip against the leading hole 26 bored by the second cutter head 24, so as to secure the boring system 12 in position within the bored hole 20.

In an embodiment, the gripper arrangement 60 includes a pair of diametrically opposed, curved clamps 62 (also known as gripper shoes) that extend sidewardly away from the hollow column 14, the clamps 62 being movable between a retracted, disengaged position and an extended, engaged position in which the clamps 62 clamp against the leading hole 26 defined by the second cutter head 24, to facilitate and/or control rotation of the first cutter head 16.

Typically, a second actuator arrangement f is used to move the clamps 62 between the retracted, disengaged position and the extended, engaged position. In an embodiment, each clamp 62 comprises a plurality of clamp segments, with the second actuator arrangement 64 comprising a plurality of hydraulic actuators 66 extending between the ends of the opposed clamp segments, on either side of the column 14, so that the operation of the actuators 66 ensures that the diametrically opposed clamps 62 operate in unison.

Figure 17:
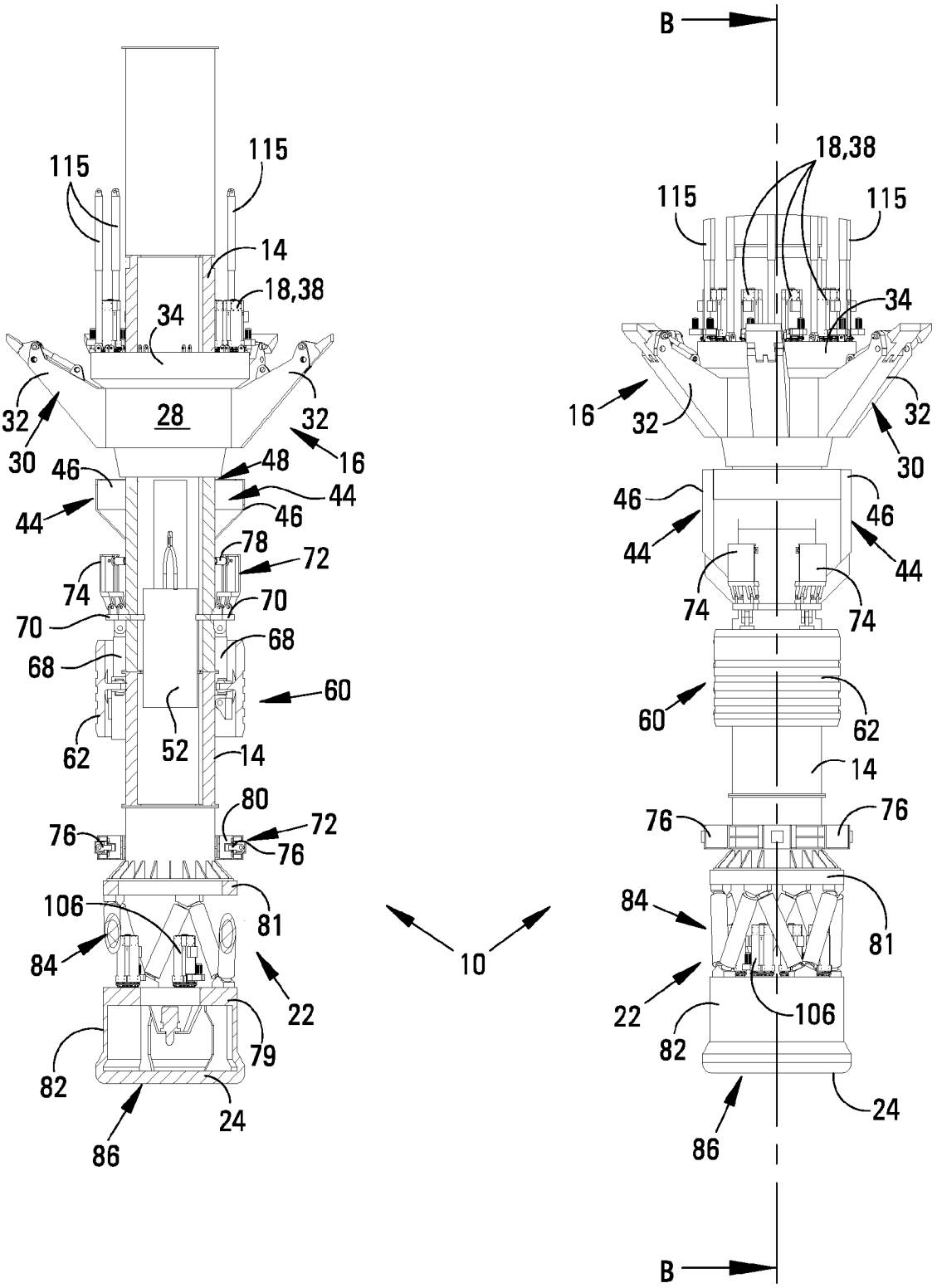
FIG. 17 shows a first side view of the portion of the boring system shown in FIG. 16, and a corresponding cross-sectional end view taken along line B-B.

As best shown in FIG. 17, the gripper arrangement 60 is fitted to a third actuator arrangement 68, comprising thrust cylinders, that is secured to the column 14 (and in particular to a flange 70 extending around the column 14. The third actuator arrangement 68 is operable to move the gripper arrangement 60 axially along the length of the column 14, to assist in the overall downward movement of the shaft enlargement arrangement 10. In use, at the start of the boring cycle, when the thrust-cylinders 68 are in a retracted position, the gripper actuators 64 are pressurised to firmly press the gripper shield clamps 62 against the wall of the leading hole/pilot shaft 20. Thus, friction is created to provide an anchoring force to accommodate the required boring thrust-forces.

In an embodiment, a stabilizing arrangement 72 is provided to assist the gripper arrangement 60 by first centering the shaft enlargement arrangement 10. The stabilizing arrangement 72 includes a plurality of radially spaced upper stabilizing shields 74 above the gripper arrangement 60, the upper stabilizing shields 74 being positioned proximate, and typically between, the pair of diametrically opposed lower collecting bunkers 44. The stabilizing arrangement 72 further includes a pair of radially spaced lower stabilizing shields 76 below the gripper arrangement 70, the lower stabilizing shields 76 being positioned proximate, and typically, above the boring head arrangement 22.

The stabilizing arrangement 72 is used to correctly position the shaft enlargement arrangement 10, prior to the activation of the gripper arrangement 60. The upper and lower stabilizing shields 74, 76 are hydraulically operated by fourth and fifth actuator arrangements 78, 80, respectively, which are arranged to move the upper and lower shields 74, 76 between a retracted, disengaged position and an extended, engaged position in which the shields 74, 76 clamp against the leading hole 26 defined by the second cutter head 24.

Figure 19:
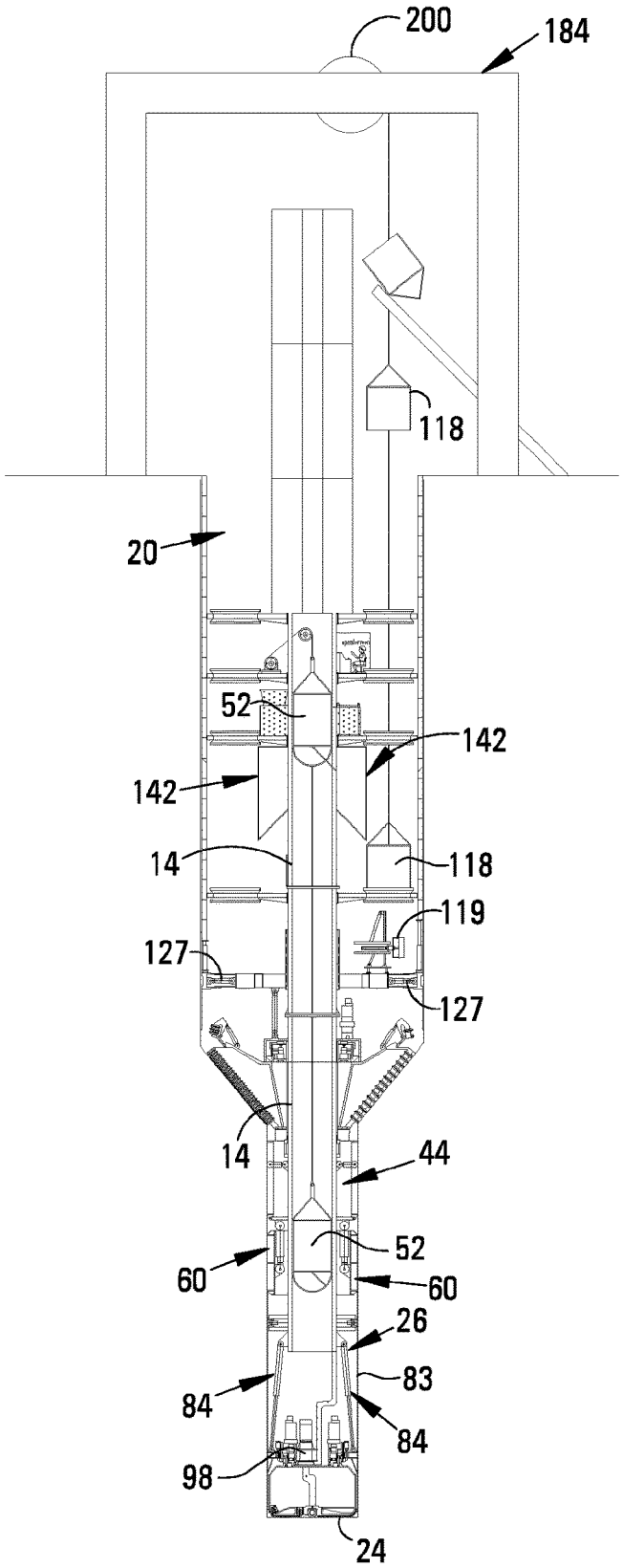
FIG. 19 shows a schematic side view of the boring system shown in FIGS. 1 and 2, illustrating the movement of an inner kibble to lift rock cuttings up the central column to the upper collecting bunker, and an outer kibble to receive the rock cuttings via the upper collecting bunker, the outer kibble then being lifted up to surface to allow for the collection and disposal of the rock cuttings.
Figure 20:
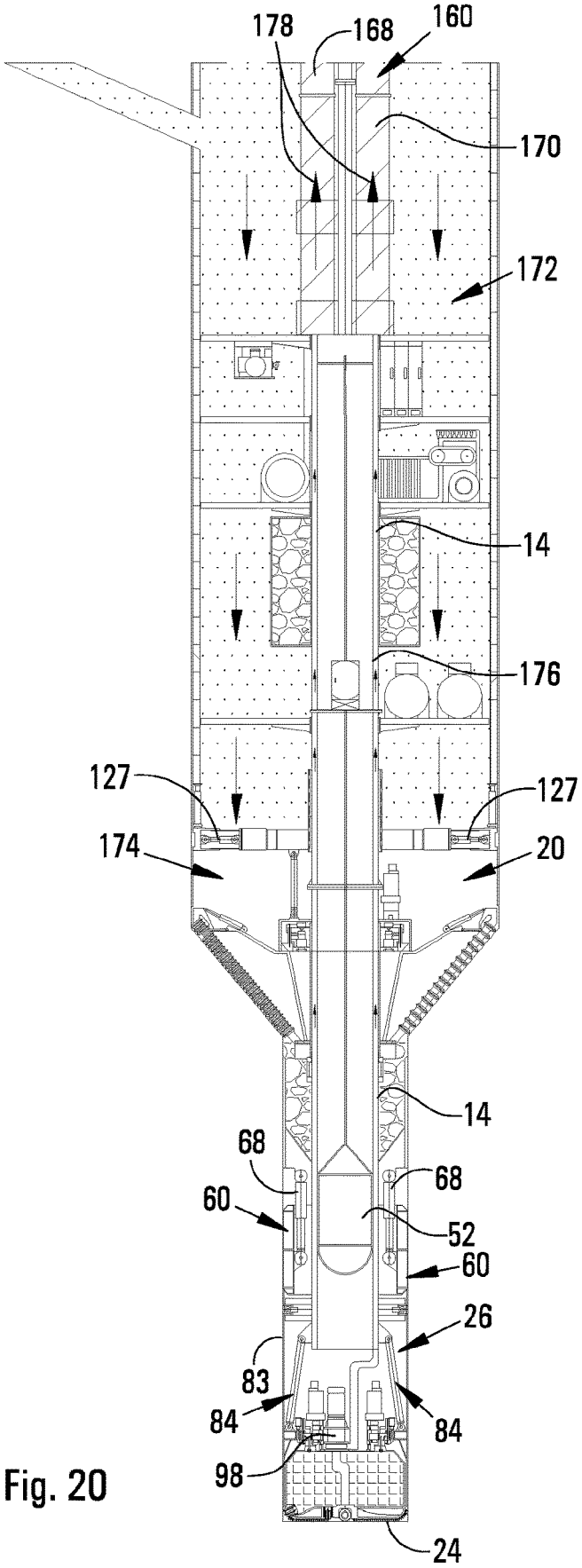
FIG. 20 shows a schematic side view of the boring system shown in FIGS. 1 and 2, illustrating the ventilation system used in the boring system.
Figure 21:
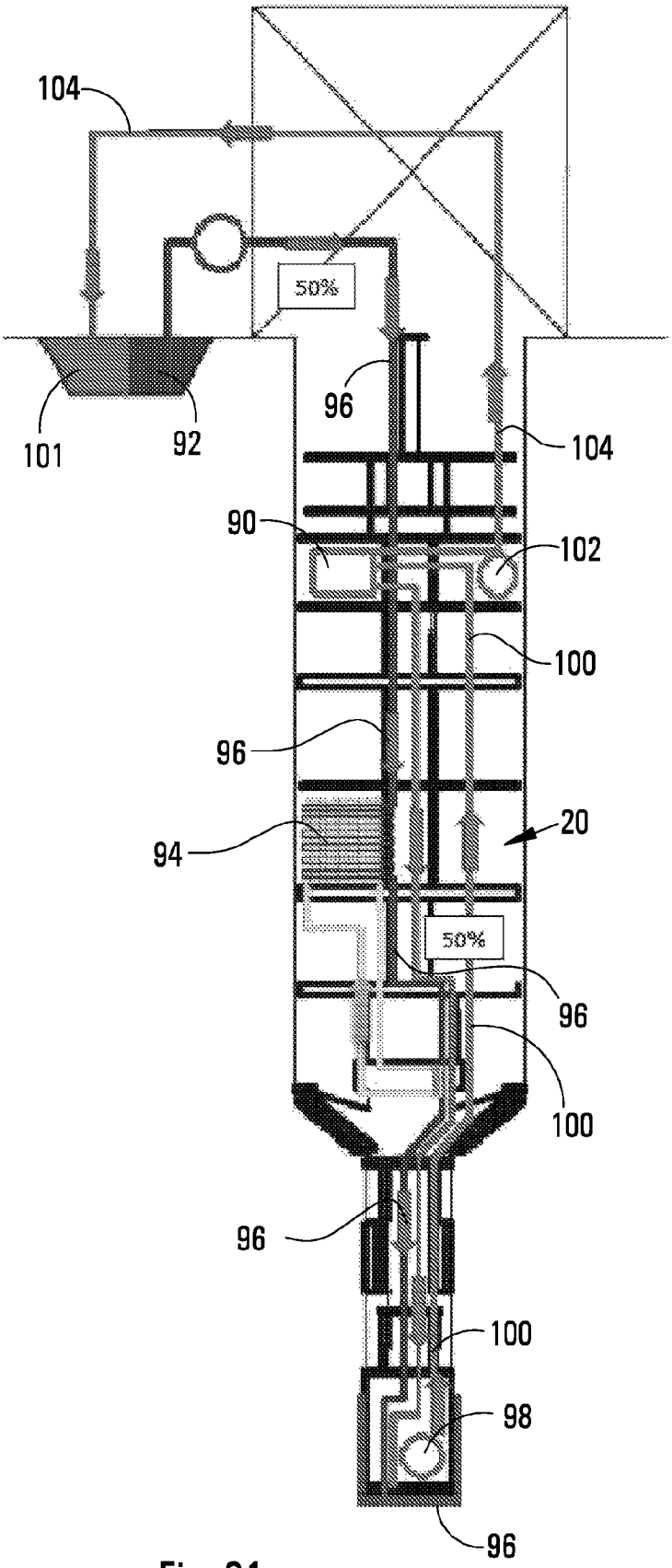
FIG. 21 shows a schematic side view of the boring system shown in FIGS. 1 and 2, illustrating the flow of water through the boring system.

In an embodiment, as shown in FIGS. 19 and 20, a protective tubular shield support arrangement 83 extends from below the first cutter head 16, adjacent the lower collecting bunker 44, to the end of the boring head arrangement 22. The protective shield arrangement defines windows or apertures to accommodate (and thus allow the operation of) the clamps 62 of the gripper arrangement 60, and the upper and lower stabilizing shields 74, 76 of the stabilizing arrangement 72. The shield support arrangement is typically segmented, to ensure that it remains in contact with the surrounding rock in order to support the wall of the leading hole/pilot-bore. The shield support arrangement is of a segmented and expandable design. In order to ensure support of the leading hole/pilot shaft 20, the outer-diameter skin of the segments of the shield support arrangement are extended by staggered steel-strips, which are guided onto the rock but can be freely pulled during advance-stroke of the slurry boring head unit. This ensures that the opening area of rock-surface remains supported as the boring system 12 advances. The shield segments are clamped to a drive-module housing 79 of the boring head arrangement 22 (as best shown in FIGS. 17 and 18), which allows for radial expansion of the shield segments and floating of the shield-structure during boring stroke and steering of the slurry-head unit. The shield segments are always keep in pressure-contact with the wall of the pilot bore 20 by means of horizontally arranged hydraulic cylinders; thus providing efficient wall-supports even in adverse ground conditions.

Figure 16:
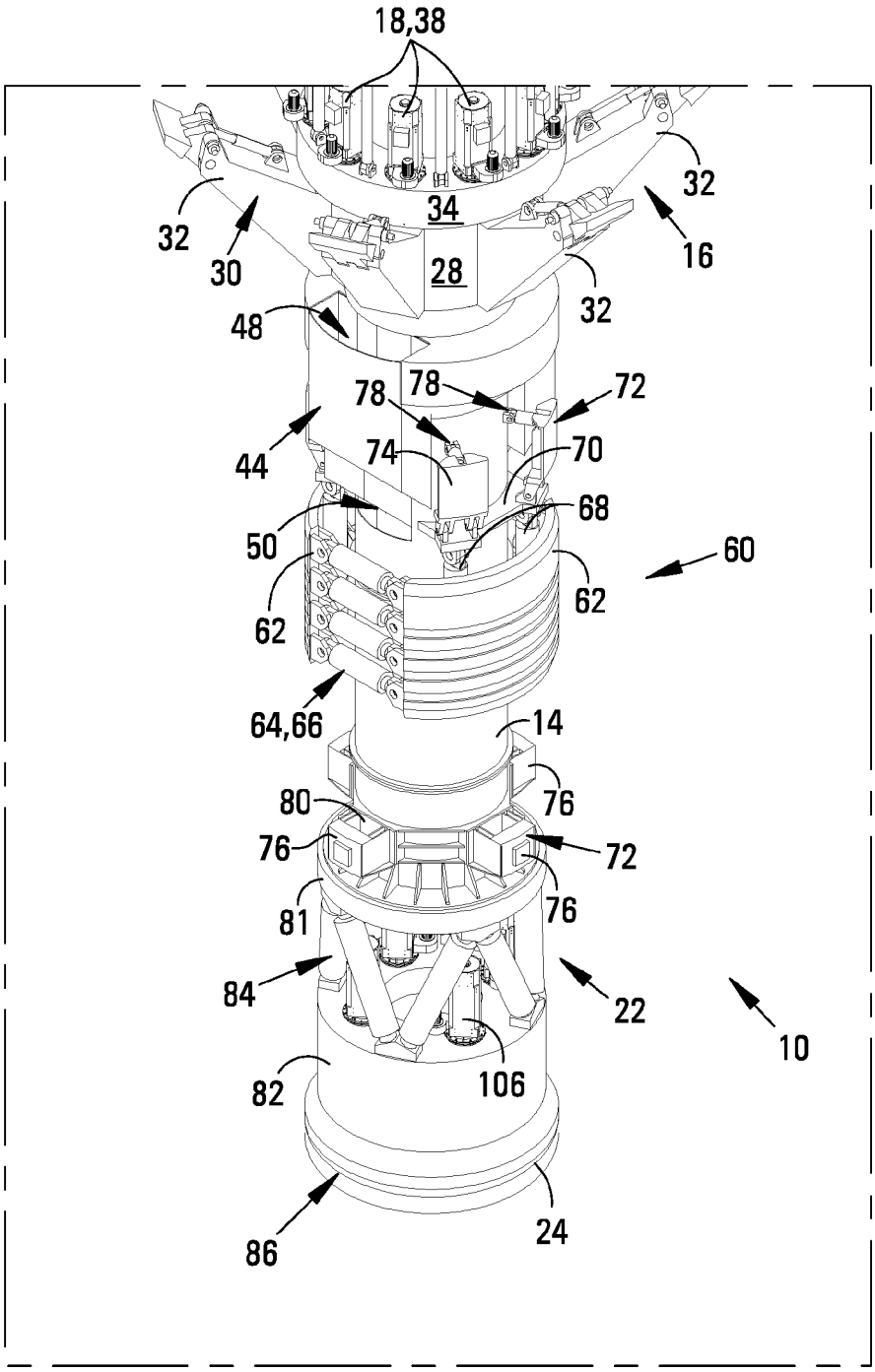
FIG. 16 shows a perspective view of the first cutter head, the lower collecting bunker, the gripper arrangement and a boring head arrangement, all used in the boring system shown in FIGS. 1 and 2.

As best shown in FIGS. 16, 17 and 18, the boring head arrangement 22 may be fitted to a flange 81 secured to the operatively lower end of the column 14, with a boring head 82 being fitted, in a spaced apart manner, to the flange 81 with a sixth actuator arrangement 84 comprising a plurality of thrust cylinders. The sixth actuator arrangement 84 is operable to extend and retract the boring head 82 relative to the flange 81, thus facilitating the boring of the leading hole 26 as the boring system 12 proceeds to bore downwardly.

The boring head 82, in addition to boring the leading/pilot hole 20, may be used to conduct exploration, so that as the boring system 12 continues to bore downwardly, information regarding the ground being bored into/through is continuously being extracted. This exploration enables the operator to determine, for example, how best to stabilise the bored shaft.

The cylinders of the sixth actuator arrangement 84 provide thrust and steering functionality, and typically comprise 5 pairs of hydraulic thrust-cylinders which inter-connect the drive-module-housing 79 with the gripper arrangement 60 via flange 81. The two cylinders of each pair are in a V-shape arrangement. The stroke of the hydraulic cylinders is individually controlled by either oil-pressure or oil volume for directional control during the boring-stroke of the boring head 82. Besides developing the boring-thrust force, the pairs of V-shape arranged thrust-cylinders 84 also create a rotational force which is controlled to counter-act the second cutter head 24 torque reaction forces. Once the thrust-cylinders 84 have completed the full boring-stroke, the boring head 82 can be pulled back above the level of the slurry in the leading/pilot hole 20. This retracted position of the second cutter head 24 allows for maintenance, inspection of cutting-tools and/or changing of cutters without the necessity of removing the slurry from the leading/pilot hole 20, e.g. to a storage-tank on an upper platform or even to surface.

In an embodiment, a laser control system is provided to control the following directional control parameters: theoretical axis of shaft; actual position of bored pilot-shaft in relation to theoretical shaft axis; indication/advice of required correction of the boring head direction; actual roll-position of the boring head 82 in relation to the first cutter head 16; and forecasting the position of the boring head 82.

In one version, and as illustrated in the drawings, for boring through hard rock, the boring head 82 comprises a slurry boring head 82 terminating in an operatively flat face 86 to define a slurry shield, the flat face 86 being fitted with the second cutter head 24 to bore the leading hole 26 as the boring system 12 progresses downwardly.

The second cutter head 24 is of a heavy duty welded steel-construction which is suitable for vertical boring in adverse ground conditions as well as in very hard rock-formations. The one-piece steel-body of the slurry boring head 82 is of a hollow design which may be safely by personnel to perform any required maintenance. In particular, the cutters of the second cutter head 24 can be safely inspected and exchanged from inside the cutter head 24.

In an embodiment, the slurry boring head 82 is filled with water slurry to apply hydrostatic pressure to the excavation face. A pump 98 is provided to pump the resulting muck into a separation plant 90 on one of the superjacent platforms, to separate the muck into particulate material and dirty water. In use, and with reference to the attached water schematic in FIG. 21, clean water 92 is pumped down into the bored hole 20, interacts with a heat exchanger 94 to facilitate cooling of the equipment in the hole 20, and ultimately ends up at the bottom of the bored hole 20 by the slurry boring head 82, as indicated by arrowed lines 96.

In an embodiment, the slurry boring head 82 is a directionally controlled single-shield slurry unit with a special rotating second cutter head 24 for boring downwards. The cut rock is suspended in the slurry in and around the cutter-head area. The slurry boring head 82 is fitted with a slurry pump 98 to pump the resultant muck (or at least a portion of the muck) up into the separation plant 90, as indicated by arrowed lines 100. The resulting dirty water 101 (or a portion of the dirty water) is then pumped, by water pump 102, up to surface to be cleaned, as shown by arrowed line 104. This cycle continues by then pumping an amount of clean water, which is more or less the same as the dirty water that was pumped out, back into the bored hole 20, so as to replace the dirty water that was removed.

The hollow areas inside the cutter head 24 provide space for sufficient volume of water/slurry to enable muck-removal from the face by means of the submerged slurry pump system. The shape of the flat cutter head 24 front-plate features the typical design used in the "reverse circulation" vertical boring method. In order to create the required slurry velocity for efficient "vacuum-cleaning" of the muck from the pilot shaft face, the distance from the cutter head front plate to the boring face is reduced and radially orientated channels are provided which lead the muck to the slurry-pump suction opening near the center of the cutter head 24. The cutter head 24 is typically equipped with standard heavy duty 17" disc-cutters. The cutter spacing is such that the size of rock-cuttings can easily be handled by the slurry pump-system and that even very hard rock-formations can be bored.

The heart of the muck-removal system is the heavy duty impeller slurry pump 98 which is installed in the center of the slurry boring head 82 submerged below the slurry level. The pump 98 is supported to the stationary inner part of the drive-module housing 79 and is driven by a frequency controlled and water-cooled electric motor which ensures sufficient flow-speed and pressure to deliver the slurry with the muck to the separation plant 90. The pump 98 geometry allows for all rock-cuttings to pass through the impeller; abnormal size rock pieces will be diverted from the slurry suction to be re-crushed by the second cutter head 24.

The slurry delivery line is either a steel-tube or armed rubber-tube; it stretches from the pump 98 upwards through the drive-module housing 79 to the centre column 14. The column 14 is a double walled column to as to define an annulus comprising a plurality of passages, one or more of which is used to accommodate the slurry delivery line up towards the separation plant 90. Between the slurry boring head 82 and the column 14 in the pilot hole, a telescopic section of the delivery-line is installed with two in-line flexible couplings allowing for longitudinal adjustment and directional control movements during the advance of either the slurry boring head 82 or the first cutter head 16 of the reamer unit.

The separation plant 90 comprises a series of sieves with different mesh-sizes which allow for rapid muck separation; only small size particles are slipping through the system and run with the slurry into a multi compartment tank before it flows back down to the slurry boring head 82.

In another application, when boring through relatively soft ground, the boring head 82 comprises an EPB (Earth Pressure Balance) head with a cutter head. The EPB uses the excavated material to balance the pressure at the tunnel face. Pressure is maintained in the cutter head by controlling the rate of extraction of spoil through an Archimedes screw and the advance rate. Additives such as bentonite, polymers and foam can be injected ahead of the face to increase the stability of the ground. Additives can also be injected in the cutter head/extraction screw to ensure that the spoil remains sufficiently cohesive to form a plug in the Archimedes screw to maintain pressure in the cutter head and restrict water flowing through.

In an embodiment, the second cutter head 24 is fitted with, or includes, a plurality of second cutter elements, with second drive means 106 being fitted atop the boring head to drive the second cutter elements of the boring head 82. Typically, the drive means 106 comprises a plurality of electric motors that extend into the gap between the boring head 82 and the flange 81. The drive means 106 is part of a cutter head 24 drive-module assembly that consists of the following main components: drive-module housing 79, as best shown in FIGS. 17 and 18, a main bearing and a related sealing arrangement, and the drive motors 106 with planetary gear-boxes and drive-pinions. The outer stationary part of the main bearing is connected to the drive module housing 79, which in turn is linked to the cutter head shield assembly 83. The cutter head 24 is attached to the inner rotating part of the main bearing.

A plurality of electrical drive motors 106 and planetary gear-boxes is attached to the drive-module housing 79 with the drive-power (torque and speed) being transferred via the drive-pinions which are matching with the bull-gear of the main-bearing. The drive-module is surrounded by the cutter head shield (i.e. the protective tubular shield support arrangement referred to above) and is propelled downwards during boring-operation by the thrust cylinders of the sixth actuator arrangement 84.

The boring system 12 further includes a shaft lining stage 110, which will now be described with particular reference to FIGS. 8, 9, 11, 12, 13 and 14. The shaft lining stage 110 comprises a circular shaft lining platform 112 having an inner collar 114 that loosely accommodates the column 14, with a plurality of thrust cylinders 115 (as best shown in FIG. 11) extending between a lower face of the platform 112 and the gearing housing 34 to regulate and control the relative distance between the platform 112 and the gearing housing 34 (and thus between the platform 112 and the support body 28 of the first cutter head 16).

In an embodiment, the shaft lining stage 110 includes a shaft lining system for installing precast concrete lining segments 116 to the inside wall of the bored hole 20 as the boring system 12 progresses downwardly. The shaft lining system comprises a lining segment carrier device 118 to lower lining segments 116 into the bored hole 20, and a segment fitting arm 119 (as shown in FIG. 19) to retrieve the lining segments 116 from the lining segment carrier 118 device and to place them against the side wall of the bored hole 20. All around the platform 112, a double rail-track may be fixed to the deck to support a dual carrier-system, provided with the fitting arm 119, which allows for the installation of the lining segments 116. If required, support equipment for anchor-drilling, probe-drilling and/or ground injection-drilling may also be supported on the platform 112.

In an embodiment, the lining segment carrier device 118 corresponds to an outer kibble, so that as the outer kibble 118 is lowered into the hole 20, a lining segment 116 is simultaneously lowered into the hole 20. In an embodiment, the outer kibble 118 passes through apertures 120 defined in superjacent circular platforms 122, with the shaft lining platform 112 of the shaft lining stage 110 also defining an aperture 120 to allow the outer kibble 118 to progress further downwardly towards the first cutter head 16.

In an embodiment, each circular platform 122 defines a pair of diametrically opposed apertures 120. In an embodiment, the circular shaft lining platform 112 of the shaft lining stage 110 has a larger diameter than the superjacent platforms 122, with the difference in diameters being sufficient to accommodate the thickness of the concrete lining segments 116 being fitted to the inside wall of the bored hole 20 (for reasons that will become clearer further below).

In an embodiment, the shaft lining platform 112 of the shaft lining stage 110 is surrounded by the multi-functional shield 42 that extends transverse to the shaft lining platform 112 so as to abut against the inside wall of the bored hole 20.

The shield 42 is releasably securable to the shaft lining platform 112 by a securing arrangement 124, the securing arrangement 124 comprising a plurality of radially extending channels 126 defined in the shaft lining platform 112 (as best shown in FIG. 13). Each channel 126 includes a movable arm 127 (best shown in FIGS. 19 and 20) that can move between a retracted, disengaged position, in which the shield 42 is disengaged from the shaft lining platform 112, and an extended, engaged position, in which the arm protrudes from the channel 126 to engage a securing aperture 128 defined in the shield 42 (typically midway along the height of the shield 42) so as temporarily secure the shield 42 relative to the shaft lining platform 112.

In use, the shield 42 is typically maintained in the extended, engaged position. However, in certain applications and/or at certain points as the hole 20 is being bored, it may be necessary to disengage the shield 42. This may occur, for example, when the column 14 needs to be lifted out of the bored hole 20. Ultimately, the shield 42 may either simply be left in place or it may be cut up and removed from the bored hole 20. The ability to line the side wall of the hole 20 as the hole 20 is being bored is clearly very advantageous.

In an embodiment, as best shown in FIG. 11, a plurality of retractable actuating cylinders 130 are provided around the platform 112, adjacent the shield 42, on the inside of the shield 42. These cylinders 130 support the lining segments 116 as they are placed against the side wall of the hole 20, so that the shield 42 is temporarily positioned between the segments 116 and the side wall.

Typically, when the cylinders 130 are in a lowered position, a segment 116 may be placed on top of the cylinder 130. The cylinder 130 may then be actuated to lift the segment 116 into place, before being grouted into place. This is a particularly unique safety feature, in that the side wall of the hole 20 is never exposed to any personnel on the platform 112; all that the personnel will see is the secured lining segments 116 and the shield 42 below the lowermost ring of lining segments 116.

In an embodiment, the shield 42 is provided with steel brushes (or inflatable bodies) that capture grout as the grout is pumped into the gap between the lining segments 116 and the side wall, thereby reducing wastage of grout. In addition, the shield 42 comprises a plurality of shield segments that can be displayed radially as the lining segments 116 are pressed against the upper portion of the shield segments during installation (as best shown in FIG. 11), to enable the shield segments to be pressed up right against the wall. In an embodiment, the vertical edges of adjacent shield segments overlap each other, and have a stepped arrangement, so as to also prevent seepage of grout through the shield 42.

In one version, the segment fitting arm extends from a hydraulic cylinder mounted on or proximate the shaft lining platform 112, and is arranged to move between various retracted and extended positions to retrieve the lining segments 116 from the lining segment carrier device 118 and to secure them against the side wall of the hole 20. The segment fitting arm can also move up and down and be rotated to facilitate the gripping, maneuvering and placement of the lining segments 116.

Figure 14:
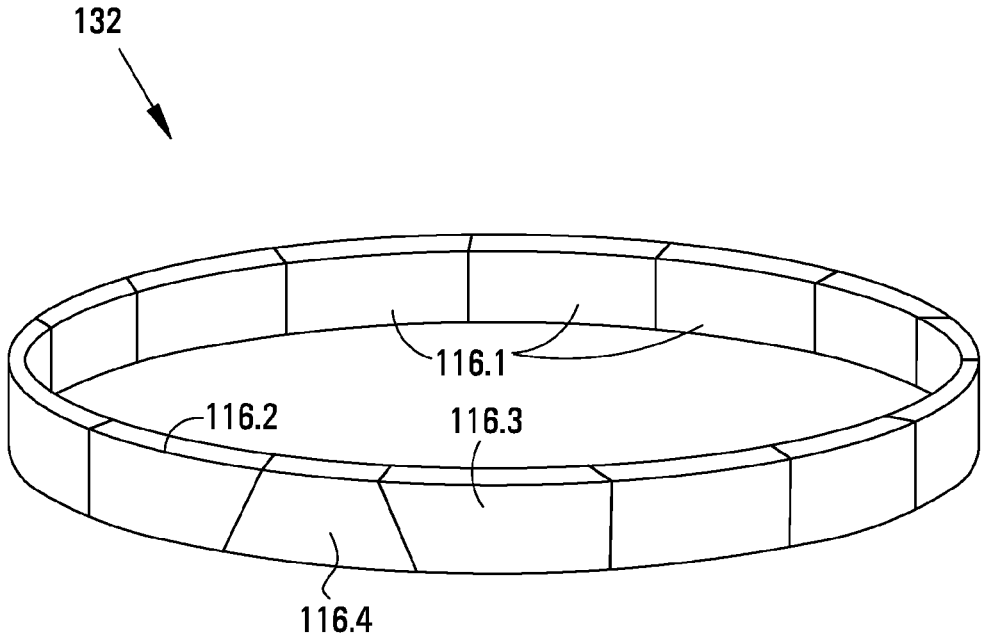
FIG. 14 shows a perspective view of a resulting ring of precast concrete lining segments that would/could be fitted to the inside wall of a bored hole.

As best shown in FIG. 14, the lining segments 116 comprise a plurality of curved primary lining segments 116.1, a pair of end lining segments 116.2 and 116.3, and a locking lining segment 116.4 for insertion between the pair of end lining segments 116.2 and 116.3, to define a ring 132 of lining segments 116. In an embodiment, the primary lining segments 116.1 are curved to ultimately define the ring 132 of lining segments 116 to line or clad the circular shaft 20. The primary lining segment 116.1 comprises a substantially rectangular body having a curved inner face and a correspondingly curved outer face arranged to abut against the side wall of the shaft 20.

In an embodiment, each end lining segment 116.2, 116.3 has a straight edge to abut against a straight edge of a corresponding primary lining segment 116.1, and an opposed angled or tapered edge. The end lining segments 116.2, 116.3 thus define a trapezoidal space or gap between them, with tapered edges, with the locking lining segment 116.4 having corresponding tapered edges so that upon insertion between the pair of end lining segments 116.2, 116.3, the locking lining segment 116.4 defines a key to lock the ring 132 of lining segments 116 together.

In an embodiment, twelve primary lining segments 116.1, two end lining segments 116.2, 116.3 and a locking lining segment 116.4 may be used to fully line a circumferential ring of the shaft 20.

Figure 2:
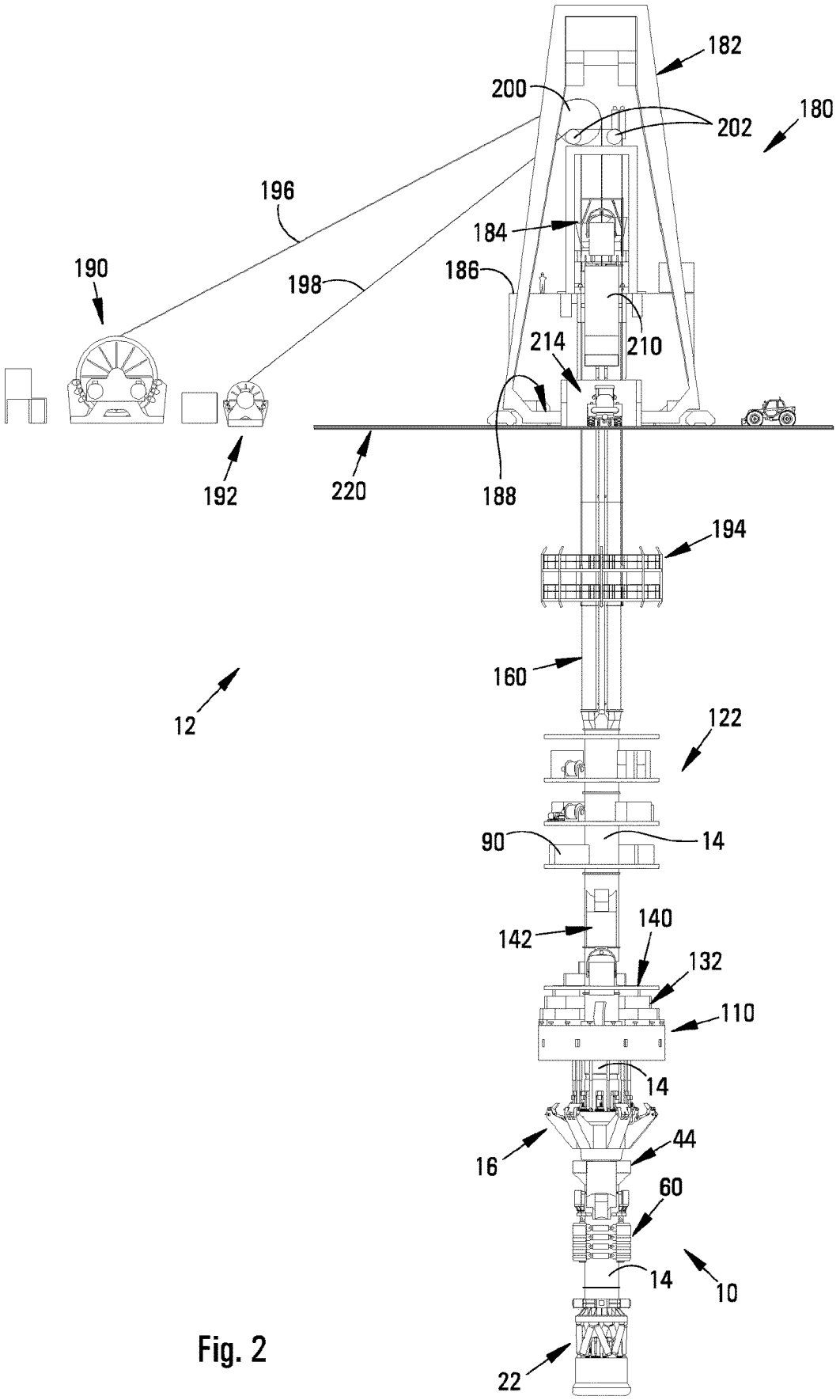
FIG. 2 shows a side view of the boring system shown in FIG. 1.
Figure 3:
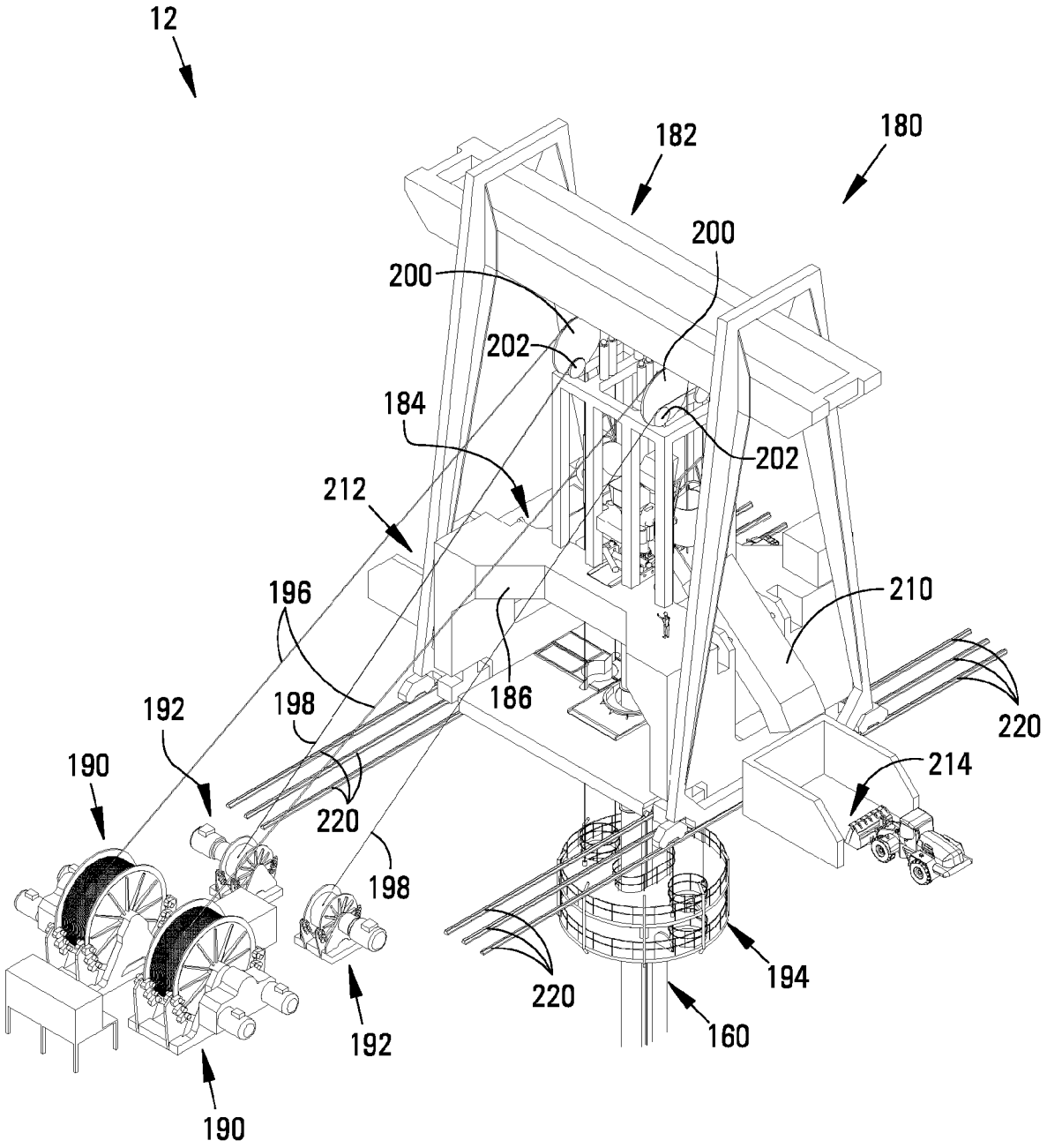
FIG. 3 shows a first top perspective view of an aboveground support rig arrangement of the boring system shown in FIGS. 1 and 2.

With reference to FIGS. 2 and 11, the thrust cylinders 115 are shown in their fully extended configurations. Typically, in use, the thrust cylinders 115 would occupy a more retracted configuration, so that the lining segments 116 would be installed directly above the first cutter head 16.

Figure 8:
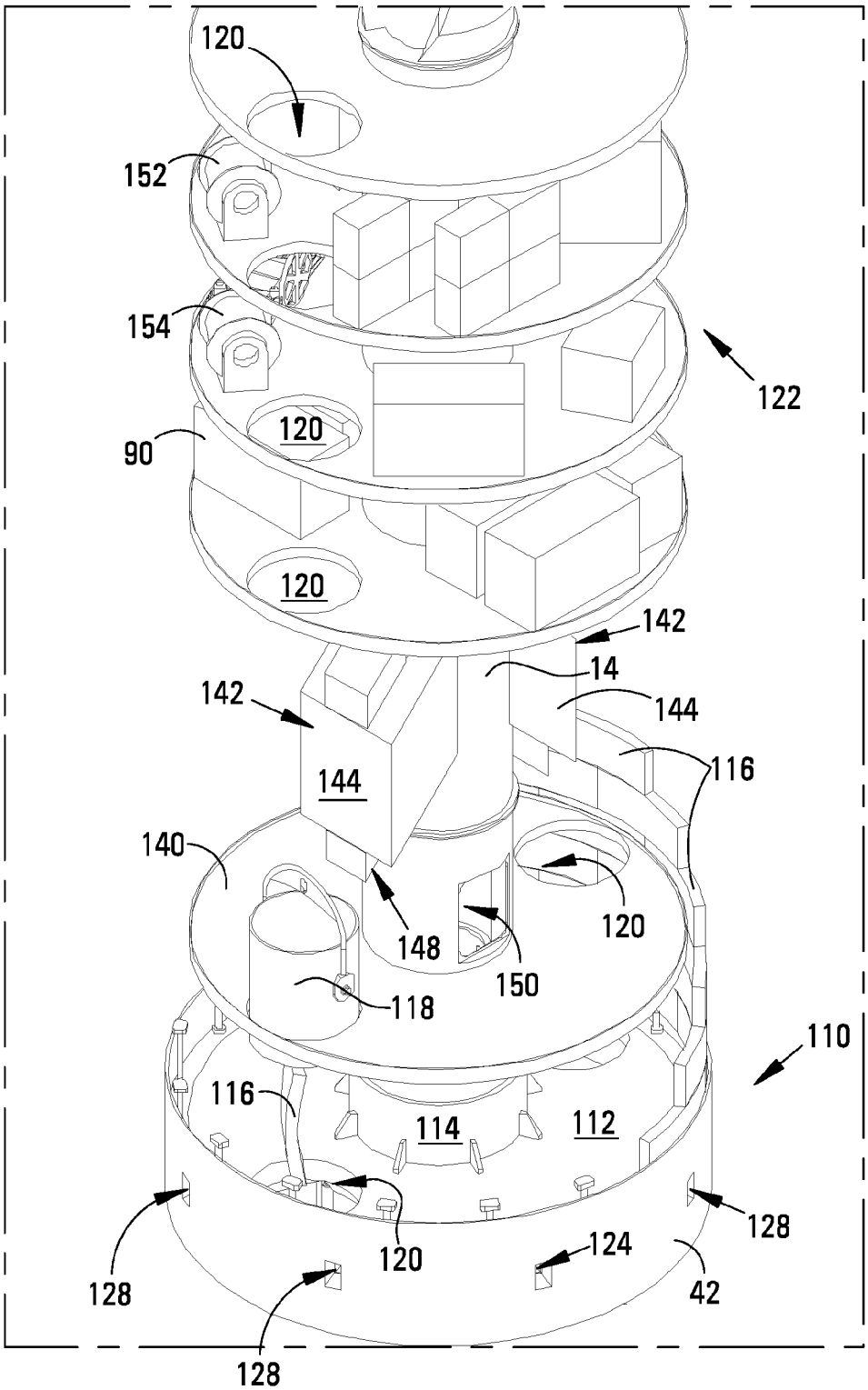
FIG. 8 shows a perspective view of a shaft lining stage, an upper collecting bunker and a plurality of working platforms, all fitted around and to a column of the down reaming boring system.
Figure 9:
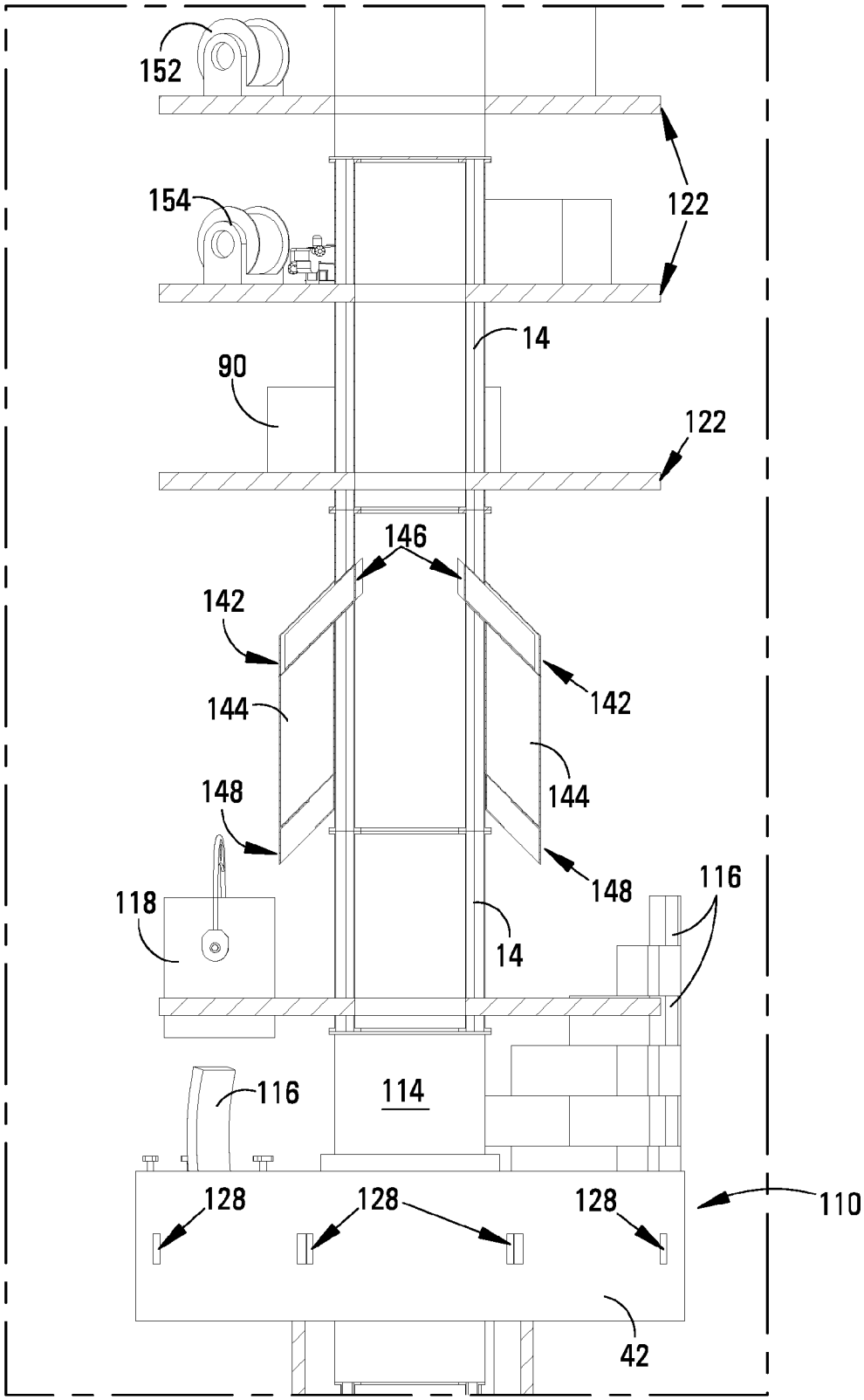
FIG. 9 shows a cross-sectional view of the portion of the boring system show in FIG. 8.

Turning now to FIGS. 8 and 9 in particular, an upper collecting platform 140 is provided above the shaft lining stage 110, above which an upper collecting bunker 142 is provided, into which cuttings being lifted by the inner kibble 52 from the lower collecting bunker 44, the kibble having moved up the column 14, can be transferred (typically by a first tipping arrangement within the column), for subsequent collection by the outer kibble 118. This arrangement is also shown in FIG. 19. The outer kibble 118 can then be subsequently lifted through the apertures 120 defined in the superjacent platforms 122 up to surface. The upper collecting bunker 142 includes a bunker body 144 defining an inlet chute opening 146 (as best shown in FIG. 9) to receive the cuttings from the inner kibble 52, and an outlet chute exit 148, on the outside of the column 14, that is line with the outer kibble 118 on the upper collecting platform 140, for subsequent collection.

Typically, a pair of diametrically opposed upper collecting bunkers 142 is provided, to deposit the cuttings into a pair of diametrically opposed outer kibbles 118.

As best shown in FIG. 8, the portion of the column 14 immediately above the upper collecting platform 140 includes a service hatch 150 to enable personnel to enter the column 14 for inspection and/or maintenance purposes.

The boring system 12 includes a plurality of superjacent working platforms 122, to define a backup system, above the upper collecting platform 140. These platforms 122 typically include hydraulics, motors, separation plants, pressure pumps, heat exchangers etc., some of which have already been described above. Each platform 122 defines a pair of diametrically opposed apertures 120 to accommodate the outer kibbles 118 moving up and down through the platforms 122. An inner kibble winch 152 is provided on one of the platforms 122, to move the inner kibble 52 up and down through the column 14. A centre column service winch 154 is also provided, to facilitate maintenance, including the changing cutters on the first cutter head 16.

Figure 15:
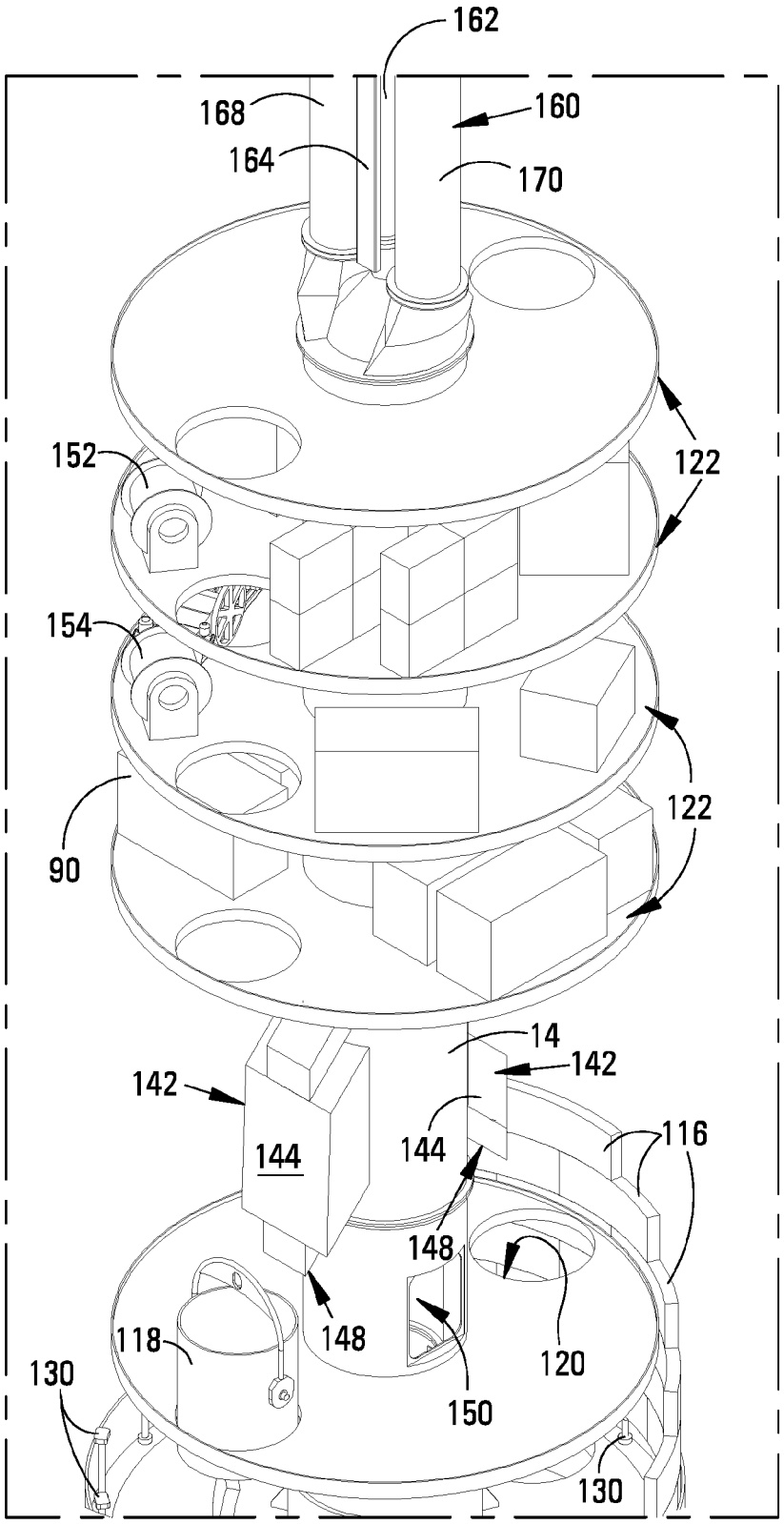
FIG. 15 shows a perspective view of a shaft lining stage, an upper collecting bunker and a plurality of working platforms, and in particular the transition from a single annulus defining column to a first drill pipe above the uppermost working platform, the drill pipe comprising a unitary body of separate, but joined, tubes and pipes.

In an embodiment, the column 14 comprises a double walled column to as to define an annulus, which in turn is separated into a plurality of passages to facilitate the transportation of fluids (i.e. liquids and gasses) up and down the column 14. Above the uppermost platform 122, as best shown in FIG. 15, the column 14 separates out into a plurality of separate tubes and pipes (but nonetheless joined together to form a unitary body, known as a drill pipe 160). Each drill pipe 160 typically includes a central string 162, which is used to support the column 14 in the shaft, a 6 inch water in pipe 164 through which water can flow downwardly (typically, clean, cold water, as described above with reference to FIG. 21), a 6 inch water out pipe 166 through which water can be pumped upwardly and outwardly (dirty water, typically, as also described above), and a pair of opposed ventilation pipes 168, 170.

The column 14 is of heavy-duty hollow steel-construction and forms the axis of the first cutter head 16, and carries all respective equipment, installations and components. The reaction-forces resulting from the boring operation are transformed through the center column 14. During boring, the column 14 supported and stabilized by means of the gripper arrangement 60 and the stabilizing arrangement 72.

With reference now to the ventilation drawing in FIG. 20, generally there is relatively clean air 172 above the first cutter head 16, and dust 174 below the first cutter head 16.

The dust is extracted up one or more of the passages in the annulus 176 of the column 14, and then continues up the ventilation pipes 168, 170 to surface, as shown by arrows 178

Turning now to FIGS. 1 to 5, the boring system 12 includes:

an aboveground support rig arrangement 180 comprising:
- a primary overhead crane assembly 182;
- a surface rig 184 to support the drill pipes 160 and the column 14, the surface rig 184 having a platform 186 that is at least 7 metres high to facilitate the assembling and disassembling, using a crosshead 187, of the drill pipes 160 which are typically 7 metres in length; and
- a work table 188, at least one kibble winder 190 to move the outer kibbles 118 up and down the shaft; and at least one stage winder 192 to move a service riding platform 194 up and down the drill pipes 160.

Figure 6:
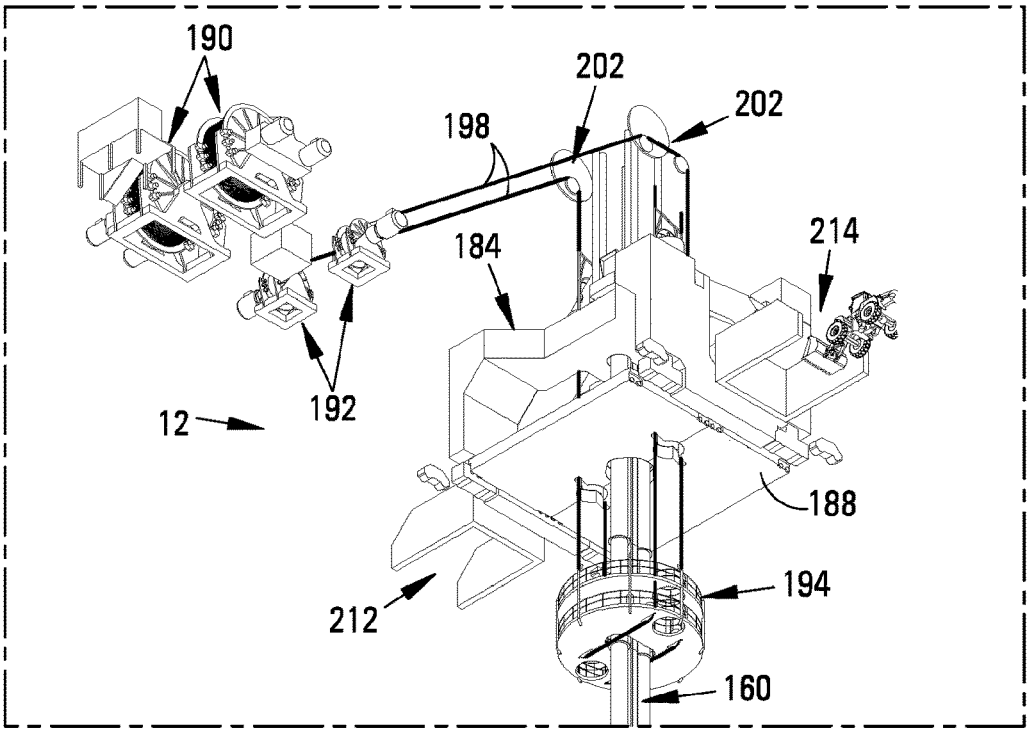
FIG. 6 shows a bottom perspective view of the aboveground support rig arrangement shown in FIG. 3 (but with an overhead crane assembly and related tracks being omitted for the sake of clarity)
Figure 7:
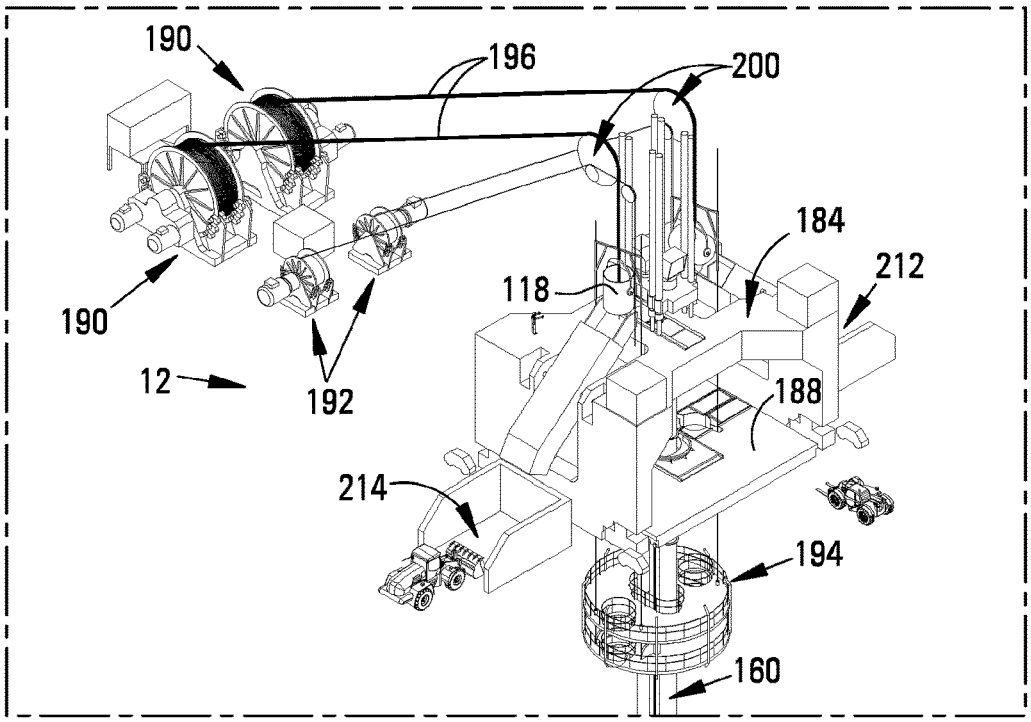
FIG. 7 shows a top perspective view of the aboveground support rig arrangement shown in FIG. 6.

As best shown in FIGS. 6 and 7, cables 196, 198 extend from the winders 190, 192, respectively, over a headgear arrangement 200, 202, respectively, on the surface rig 184, and are connected to the outer kibbles 118/service platform 194, respectively.

The cable 198 for the service platform 194, as shown in FIG. 6, goes over the headgear arrangement 202, down and around the bottom of the service platform 194 and then back up and secured in place at an upper point on the surface rig 184. There are two stage winders 192, and thus there are four cables that interact with the service platform 194.

Typically, there are two separate kibble winders 190 to enable the outer kibbles 118 to operate independently.

Figure 22:
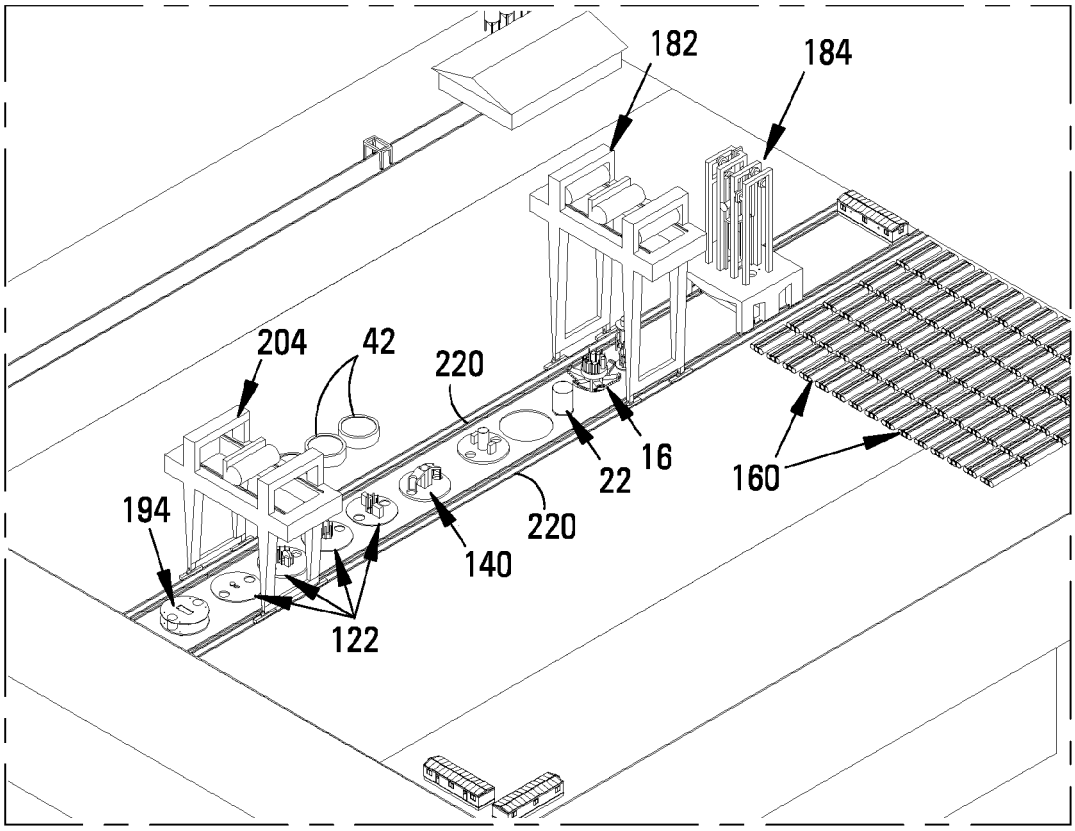
FIG. 22 shows a typical site layout at which the boring system shown in FIGS. 1 and 2 may be used.
Figure 23:
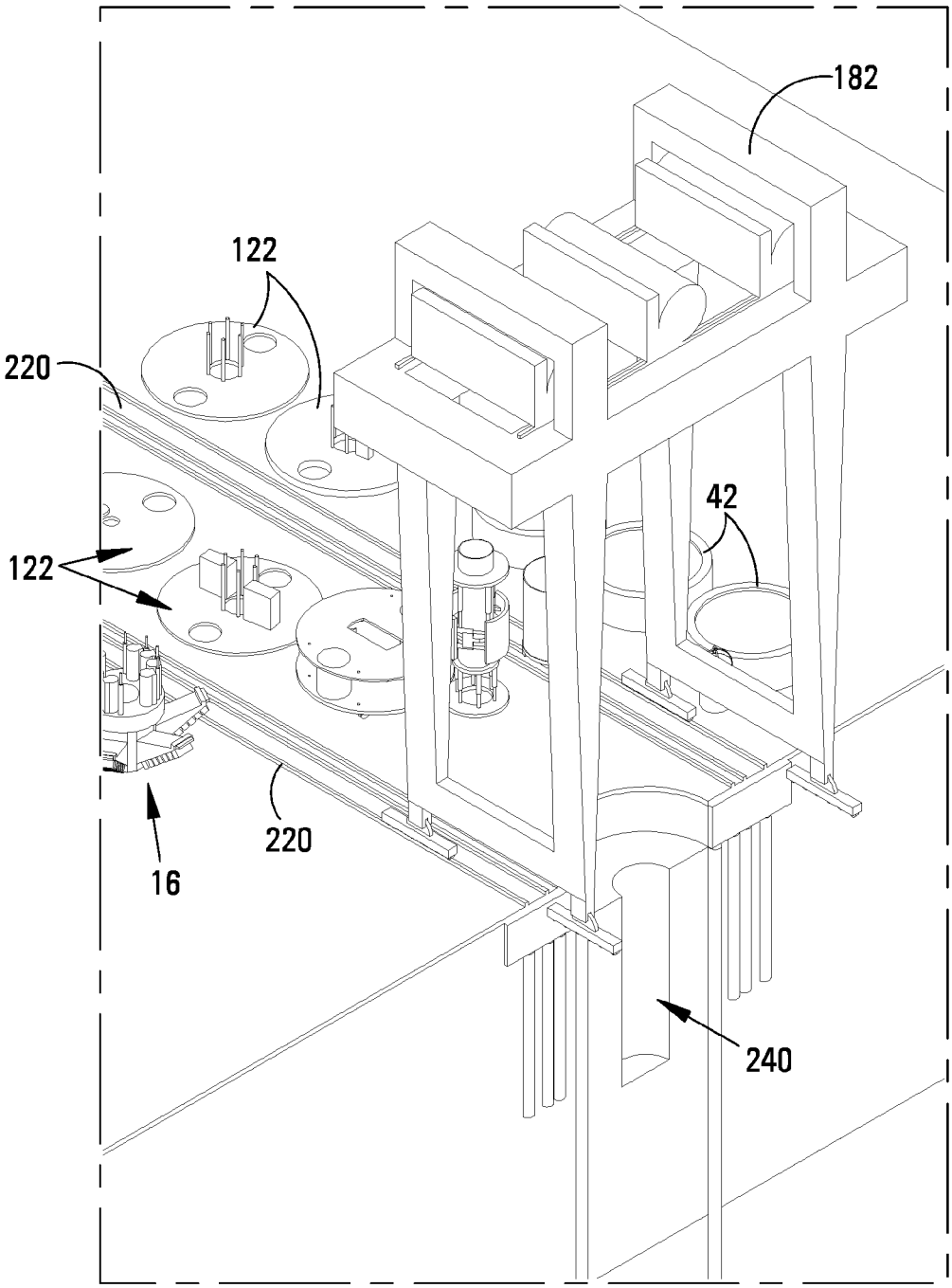
FIGS. 23 to 25 show a progression of assembling steps of the boring system shown in FIGS. 1 and 2.

A secondary overhead crane assembly 204, which is separate from the primary overhead crane assembly, is also provided, as shown in FIG. 22, to assist in preparing the site and moving various pieces of equipment on surface.

Figure 4:
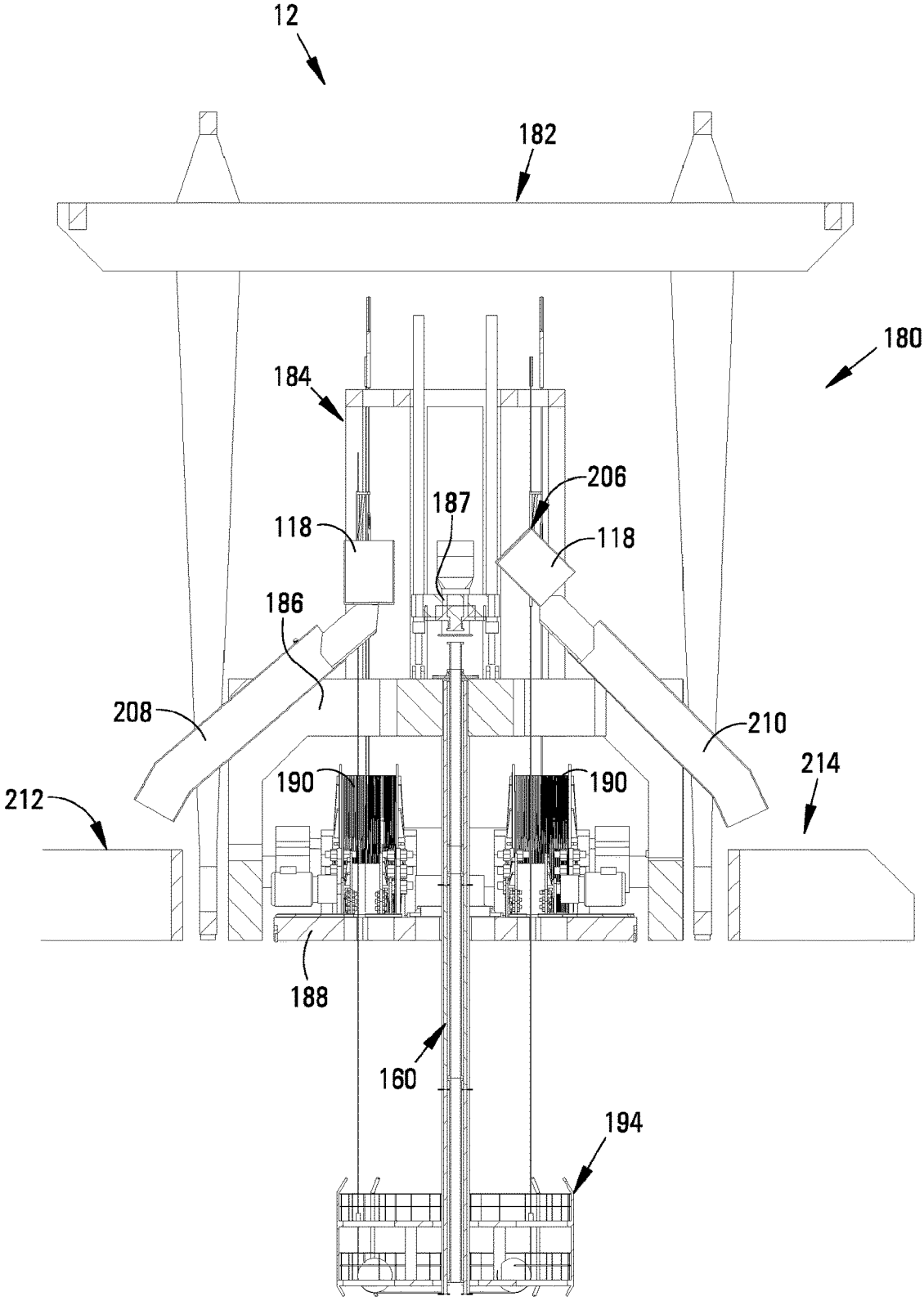
FIG. 4 shows a side view of the aboveground support rig arrangement shown in FIG. 3.
Figure 5:
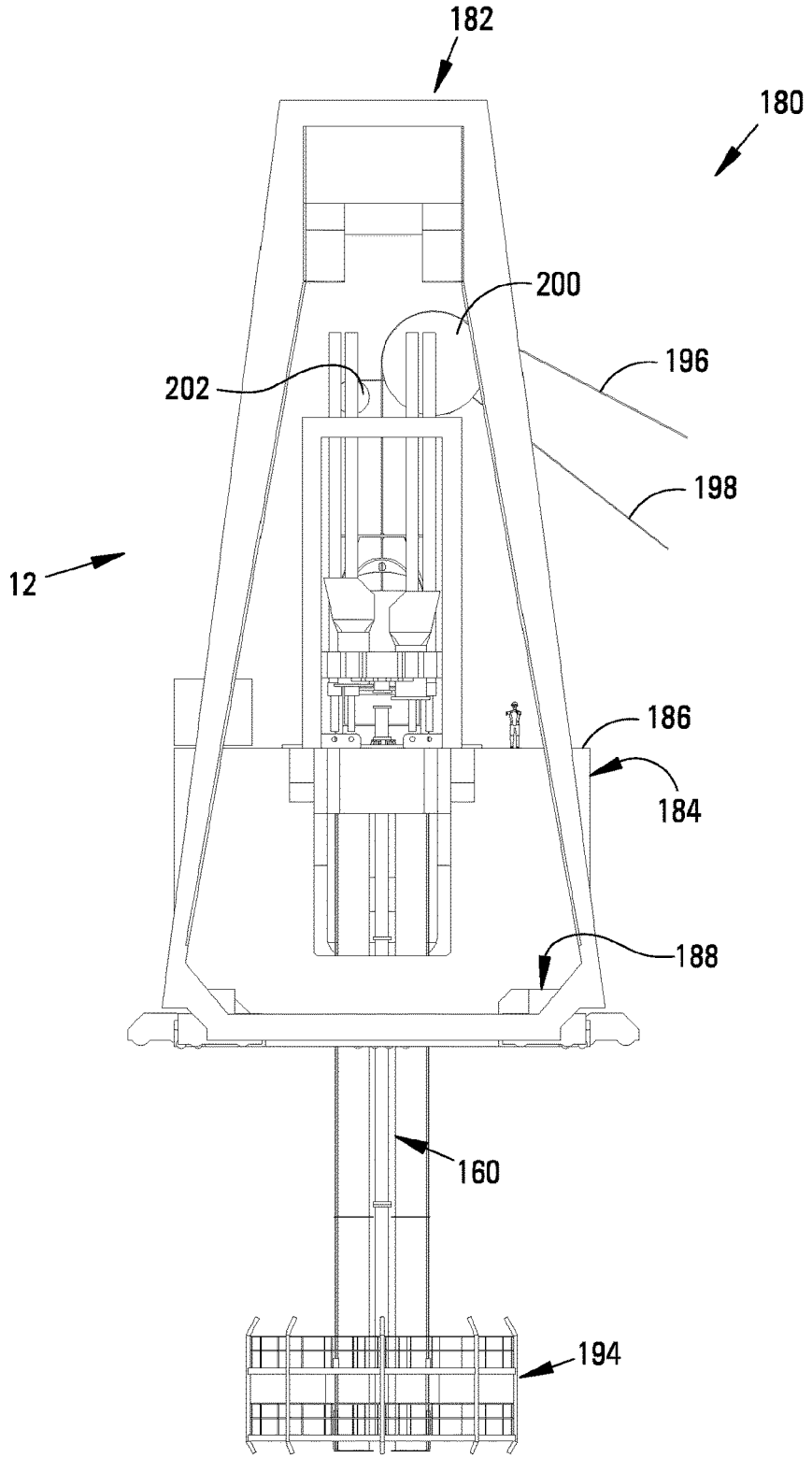
FIG. 5 shows an end view of the aboveground support rig arrangement shown in FIG. 3.

As schematically indicated in FIG. 4, a second tipping arrangement 206 is provided to tip the outer kibbles 118, once they have been lifted above the surface rig 184, into adjacent chutes 208, 210, which guide the contents of the kibbles into collection bays 212, 214 on either side of the support rig arrangement 180, for subsequent removal by suitable machinery.

In an embodiment, each of the overhead cranes 182, 204, the surface rig 184 and the work table 188 are arranged to travel on tracks 220 (or rails, which can be around 60 metres in length) fitted on surface to facilitate the setting up on site of the boring system 12.

Figure 26:
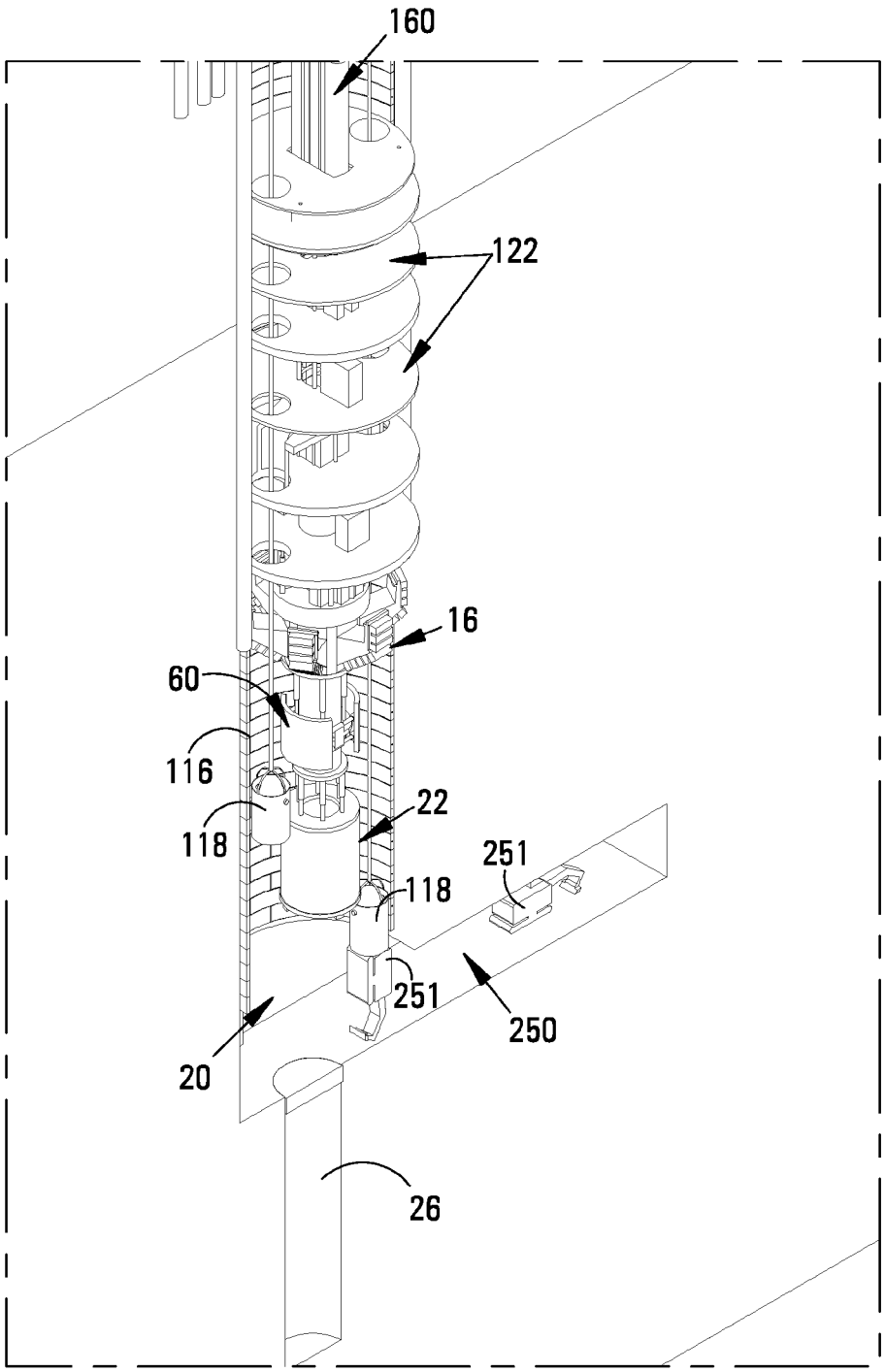
FIG. 26 shows a partly cross-sectional perspective view of the boring system in operation, with in particular a first excavation being shown.
Figure 27:
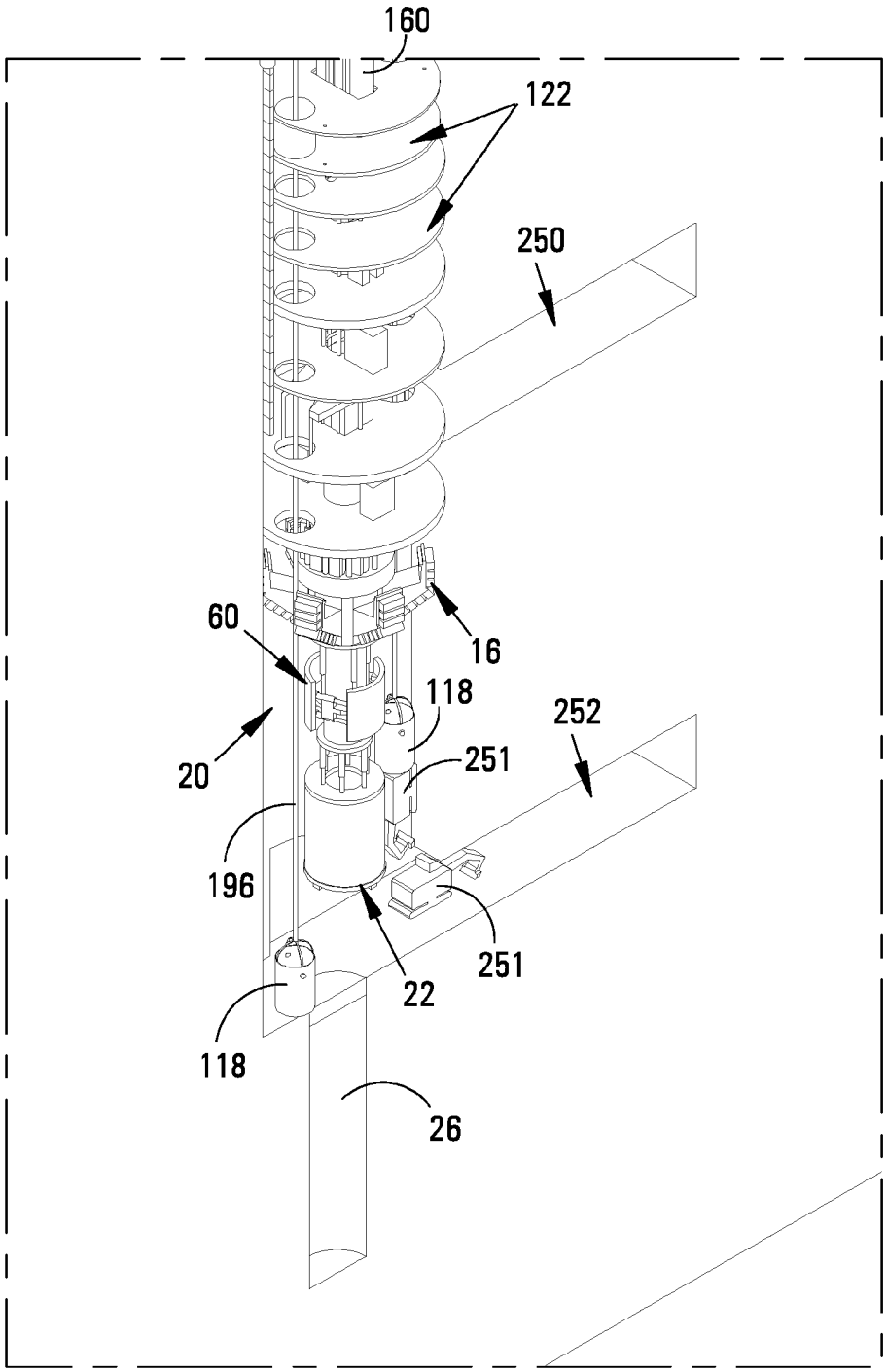
FIG. 27 shows a partly cross-sectional perspective view of the boring system in operation, with a second excavation being shown.
Figure 28:
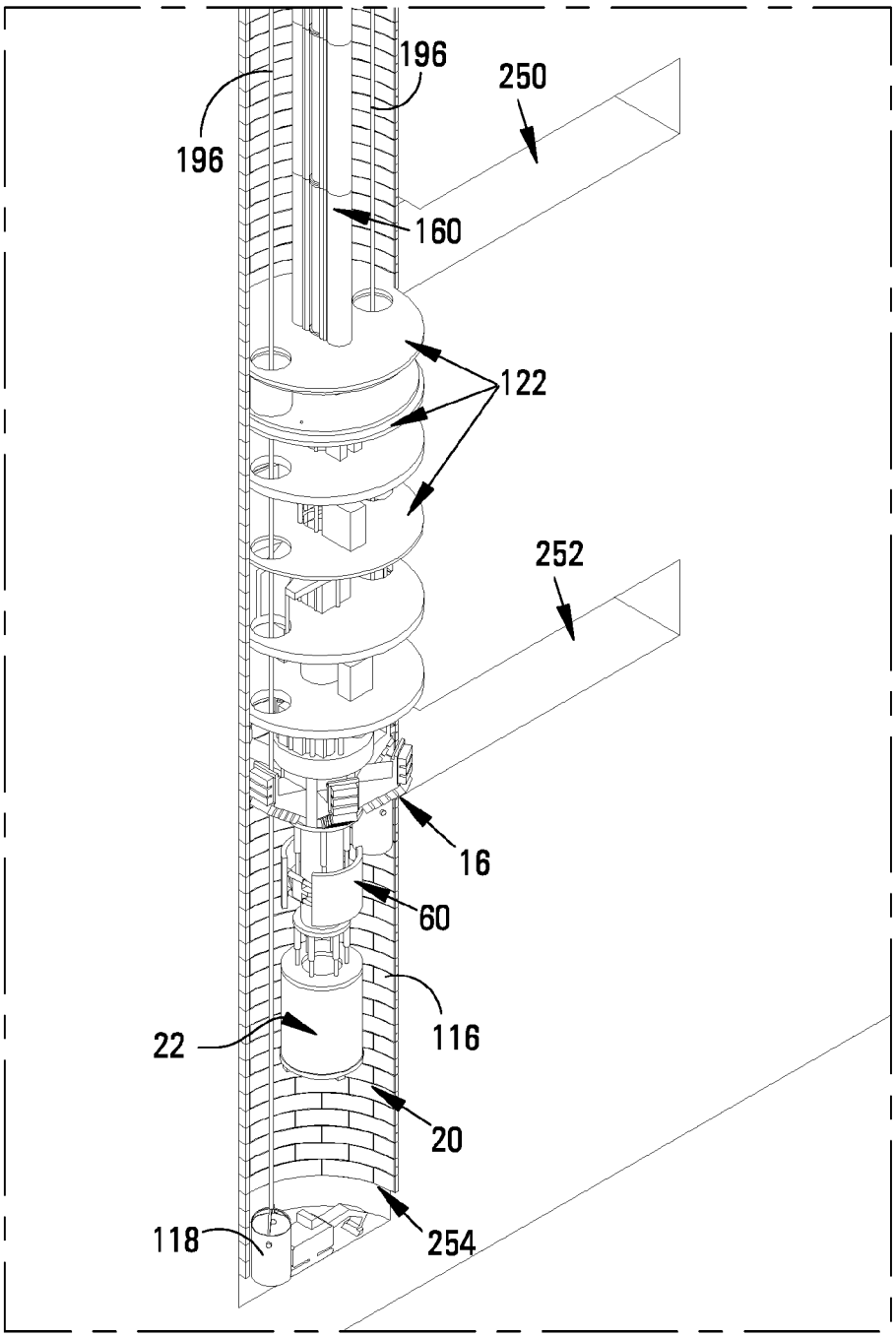
FIG. 28 shows a partly cross-sectional perspective view of the fully bored (and lined) hole.

In use, with reference to FIGS. 22 to 28, the site is first prepared by performing piling operations to support the aboveground support rig arrangement 180, preparing foundations, drilling a pre-sink 240 (although in some cases, this is not required or desired), installing the tracks 220, and setting up a precast plant. The cranes 182, 204, surface rig 184 and work table 188 are then assembled, and the winders 190, 192 installed. The various machine components are then assembled, including the boring head 82, the gripper arrangement 60, the first cutter head 16, and the various platforms 122. Boring can then commence, followed by the first cross-cut excavation 250, the second cross-cut excavation 252, and the shaft bottom 254, as shown in FIGS. 26, 27 and 28, respectively. The cross-cuts 250, 252 are used to prepare mining levels.

Typically, many of the above operations, assembling and setting up can take place simultaneously, thereby significantly reducing the overall time required to set up the site. For example, once the primary and secondary overhead crane assemblies 182, 204 have been assembled, these may in turn be used to assemble the surface rig 184 and the work table 188, respectively.

Thus, with particular reference to FIG. 22, once the site has been fully prepared, the primary and secondary overhead crane assemblies 182, 204, as well as the surface rig 184 and the work table 188 (which is hidden under the surface rig 184) are all movable along the tracks, and the various platforms 122 are arranged in the sequence in which they will be required (i.e. the lowermost platform would be closest to the presunk hole). The shield 42 for the shaft lining platform 112 as well as the drill pipes 160 (i.e. the unitary bodies of tubes and pipes), are also on hand, ready to be used.

Figure 24:
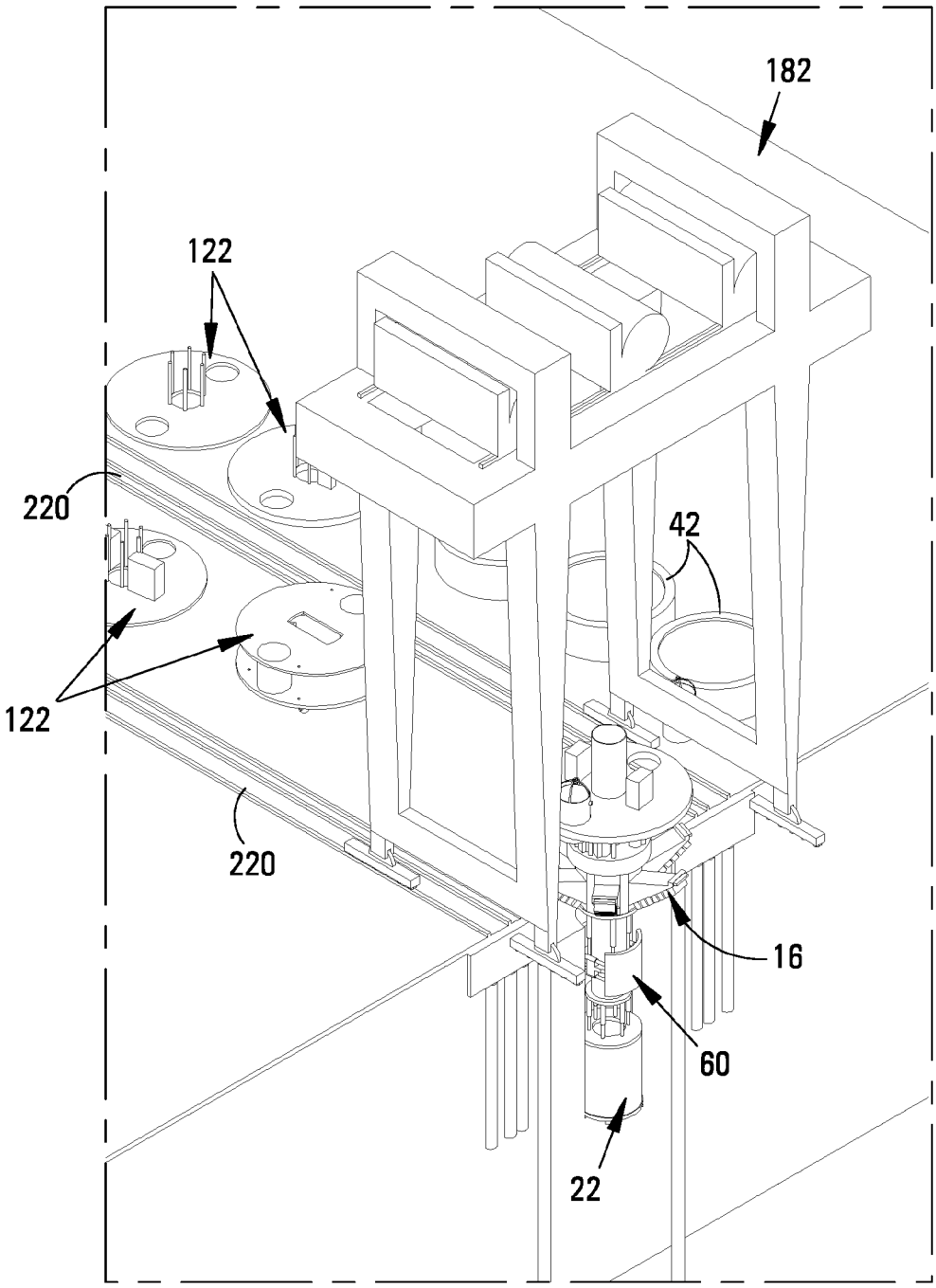
Figure 25:
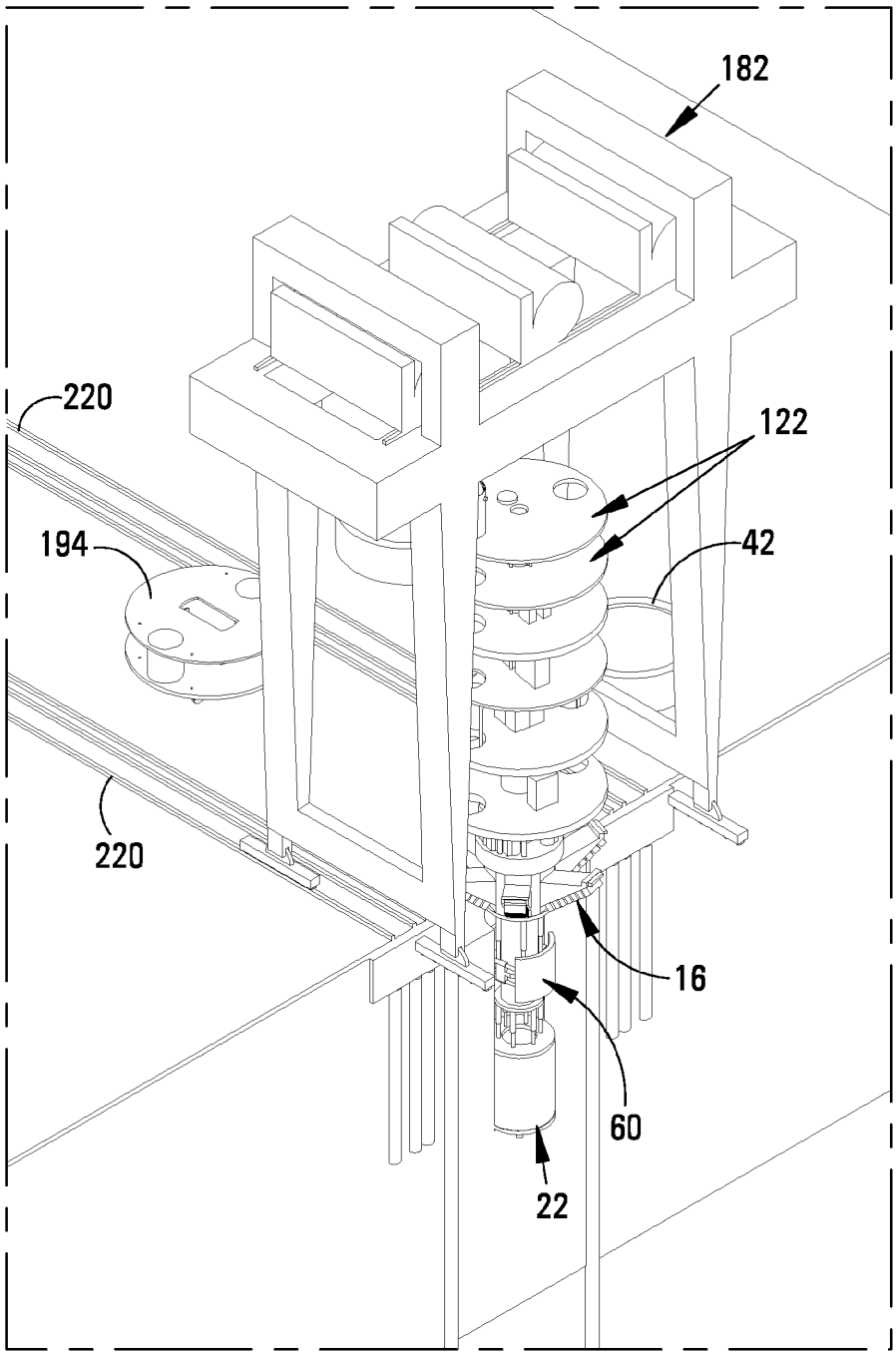

As best shown in FIG. 24, the boring head 82 is first inserted into the presunk hole 240 (if required or desired, but necessary), with the column 14 and gripper arrangement 60 then being fitted on top of the boring head 82. The first cutter 16 is then mounted on top of the gripper arrangement 60 and then the superjacent platforms 122 are then mounted on top of the first cutter head 16 to ultimately define the boring system 12 shown in FIGS. 1 and 2. This is typically done using the primary overhead crane assembly 182, with the secondary overhead crane assembly 204 being used to move the various pieces of equipment on surface. The first cutter head 16 is then actuated, and with a combination of the third and sixth actuator arrangements (to move the gripper arrangement 60 along the length of the column 14 and to advance the boring head 82, respectively), in conjunction with the gripping and releasing of the gripper arrangement 60, the boring system 12 can proceed to bore downwardly (with additional drill pipes 160 simply being added as the hole 20 advances.

When the first excavation level 250 is reached, as shown in FIG. 26, the boring head 28 and the first cutter head 16 continue to bore past this level 250, until such time that the shaft 20 above the required excavation level 250 has been lined with the concrete lining segments 116. The movable end wing portion 32.2 is then retracted/lifted using the first actuator 40 to enable the shaft enlargement arrangement 10 to be lifted sufficiently upwardly to enable the required machinery, such as a multi-purpose compact excavator 251, to be brought down through the apertures 120 in the platforms 112 to excavate the first excavation 250, with the ground/rock then being loaded onto the outer kibble 118 and then lifted up to surface.

During this excavation, the first cutter head 16 is not rotating, to enable the outer kibble 118 to be lowered all the way down, through the winged arrangement 30 of the first cutter head 16 and past the boring head 82 to where it is required. The ability of enabling equipment to travel up and down through the winged arrangement 30 of the first cutter head 16 is particularly advantageous.

The boring system of the present invention allows the construction of blind shafts from surface, with a flexible boring diameter range of, in an embodiment, between 8 and 15 metres. Maximum shaft depths of 2000 m can be reached with simultaneous execution of final shaft-lining by installation of pre-cast concrete segments. The system is able to bore shafts in adverse ground-conditions as well as very hard-rock formations.

The shaft boring is executed by means of a combination of two boring-units, namely a slurry boring head unit at the bottom of the machine (or an equivalent) and the shaft-reamer unit (i.e. the first cutter head), which are used with alternating boring cycles. In others words, the two boring units would typically not operate simultaneously i.e. the two boring units, the pilot-bore unit and the shaft-reamer unit, execute their boring-strokes in turn. In an embodiment, the stroke of the slurry boring head is two times that of the first cutter head. The slurry boring unit bores a pilot-hole of approximate 4.8 metres in diameter, which is then extended to the final boring diameter with the shaft reamer unit (i.e. the first cutter head).

The bored rock from the pilot hole is efficiently removed from the boring face by means of a slurry system, which is then separated and loaded into the surface hoisting-system (comprising a combination of the inner and outer kibbles, as described above). In particular, the pilot bore provides space underneath the larger first cutter head which allows the muck from the reaming action of the first cutter head to be collected in built-in muck-bunkers (i.e. the lower collecting bunker 44), which may be loaded into the inner kibble 52 which travels within the inside of the column 14. Above the first cutter head, the upper collecting bunker 142 allows the muck to be transferred into the outer kibbles of the surface hoisting system. The shaft wall is lined by installing the pre-cast concrete segments directly above the first cutter head while the first cutter head is advancing. This, together with the supporting tubular shield arrangement that extends from below the first cutter head to the end of the boring head arrangement, ensures support in the pilot bore as well as the enlarged shaft at all times.

It is envisaged that the boring system 12 of the present invention can bore 1.5 m/h of lined shaft, and, overall, approximately 12 metres per day. It is further envisaged that the boring system of the invention will provide a shaft axis accuracy of approximate 50 mm. The gripper/thrust system 60 is arranged to be positioned within the pilot section bored by the boring head, thus allowing for installation of the shaft lining segment 116 directly above the first cutter head 16, which conveniently ensures that the lining segments cannot be damaged by the gripper arrangement 60. Advantageously, the installation of the lining segments 116 can take place simultaneous with the boring operations of the boring head arrangement 22 or first cutter head 16.

In addition, the boring system 12 allows for the excavation of cross-cuts (such as cross-cuts 250, 252) from the bored shaft by utilizing the outer kibbles 18 of the hoisting arrangement. Advantageously, since the boring system 12 is designed to allow muck and cuttings to be transferred internally through the various platforms, the excavation of the cross-cuts can take place simultaneously.

The invention claimed is:

1. A boring system including a shaft enlargement arrangement, the shaft enlargement arrangement comprising:

a hollow column proximate a lower end of the boring system;

a first cutter head that is rotatably fitted to the hollow column, with first drive means being provided to rotate the first cutter head relative to the hollow column so as to bore downwardly a hole having a diameter corresponding substantially to the diameter of the first cutter head, the first cutter head comprising a support body carrying a winged arrangement, the support body being rotatably fitted to the column, the winged arrangement comprising a plurality of wings extending from the support body, each wing being fitted with, or comprising, a plurality of first cutter elements, each wing being angled upwardly and away from the support body so to define a substantially V-shaped cutting profile;

a boring head arrangement fitted to an operatively lower end of the column, the boring head arrangement terminating in a second cutter head to bore a leading hole as the boring system proceeds to bore downwardly;

a lower collecting bunker provided below the first cutter head, into which cuttings produced by the rotating first cutter head can be collected, the lower collecting bunker including a bunker body defining an inlet chute opening to receive the cuttings, and an outlet chute exit that is in line with a corresponding aperture defined in the column through which the cuttings can exit the bunker into the column for subsequent collection by an inner kibble travelling up and down the column; and a gripper arrangement fitted to the hollow column, the gripper arrangement being positioned, in use, below the lower collecting bunker and above the boring head arrangement, the gripper arrangement being arranged to securely grip against the leading hole bored by the second cutter head, so as to secure the boring system in position within the bored hole, the gripper arrangement including a pair of diametrically opposed clamps that extend sidewardly away from the hollow column, the clamps being movable between a retracted, disengaged position and an extended, engaged position in which the clamps clamp against the leading hole defined by the second cutter head to facilitate and/or control rotation of the first cutter head.

2. The boring system of claim 1, wherein a gearing housing is mounted above the first cutter head, the first drive means being fitted atop the gearing housing and arranged to drive a gearing arrangement within the gearing housing that, in turn, is arranged to rotate the support body and first cutter head around the column.

3. The boring system of claim 2, wherein the boring head arrangement is fitted to a flange secured to the operatively lower end of the column, with a boring head being fitted to the flange with a boring head-moving actuator arrangement, the boring head-moving actuator arrangement being operable to extend and retract the boring head relative to the flange, thus facilitating the boring of the leading hole as the boring system proceeds to bore downwardly, with the boring head comprising a slurry boring head terminating in an operatively flat face to define a slurry shield, the flat face being fitted with a second cutter head to bore the leading hole as the boring system progresses downwardly.

4. The boring system of claim 3, wherein the slurry boring head is configured to be filled with water slurry to apply hydrostatic pressure to an excavation face, with a pump being provided to pump a resulting muck into a separation plant.

5. The boring system of claim 3, wherein the second cutter head is fitted with, or includes, a plurality of second cutter elements, with second drive means being fitted atop the boring head to drive the second cutter elements of the boring head.

6. The boring system of claim 5, wherein the boring system includes a shaft lining stage comprising a shaft lining platform having an inner collar that loosely accommodates the column, with a plurality of cylinders extending between a lower face of the shaft lining platform and the gearing housing to regulate and control the relative distance between the shaft lining platform and the gearing housing, the shaft lining stage including a shaft lining system for installing precast concrete lining segments to a side wall of the bored hole as the boring system progresses downwardly, the shaft lining system comprising:

a lining segment carrier device to lower lining segments into the bored hole; and a segment fitting arm to retrieve the lining segments from the lining segment carrier device and to place them against the side wall of the bored hole.

7. The boring system of claim 6, wherein the lining segment carrier device is part of an outer kibble, so that as the outer kibble is lowered into a shaft of the bored hole, a lining segment is simultaneously lowered into the shaft, wherein the outer kibble passes through apertures defined in superjacent platforms, with the shaft lining platform of the shaft lining stage also defining an aperture to allow the outer kibble to progress further downwardly towards the first cutter head.

8. The boring system of claim 7, wherein an upper collecting platform is provided above the shaft lining stage, above which an upper collecting bunker is provided, into which cuttings being lifted by the inner kibble from the lower collecting bunker, the inner kibble having moved up the column, can be transferred for subsequent collection by the outer kibble, which can then be subsequently lifted through the apertures defined in the superjacent platforms up to surface, the upper collecting bunker including a bunker body defining an inlet chute opening to receive the cuttings from the inner kibble, and an outlet chute exit on the outside of the column that is line with the outer kibble on the upper collecting platform for subsequent collection.

9. The boring system of claim 8, wherein the boring system further includes an aboveground support rig arrangement comprising a primary overhead crane assembly, a surface rig and a work table, at least one kibble winder to move the outer kibble up and down the shaft, and at least one stage winder to move a service riding platform up and down an upper portion of the column, wherein a secondary overhead crane assembly, which is separate from the primary overhead crane assembly, is also provided, to assist in preparing a site and moving various pieces of equipment on surface.

10. The boring system of claim 9, including multiple outer kibbles, wherein a second tipping arrangement is provided to tip the outer kibbles, once they have been lifted above the surface rig, into adjacent chutes which that guide the contents of the outer kibbles into collection bays on either side of the support rig arrangement for subsequent removal by suitable machinery, and wherein each of the overhead cranes, the surface rig and the work table are arranged to travel on tracks fitted on surface to facilitate setting up on site of the boring system.

11. The boring system of claim 6, wherein the shaft lining platform of the shaft lining stage is surrounded by a shaft lining shield that extends transverse to the shaft lining platform so as to abut against the inside wall of the bored hole, the shaft lining shield being releasably securable to the shaft lining platform by a securing arrangement, wherein the securing arrangement comprises a plurality of radially extending channels defined in the shaft lining platform, each channel including a movable arm that can move between a retracted, disengaged position, in which the shaft lining shield is disengaged from the shaft lining platform, and an extended, engaged position, in which the arm protrudes from the channel to engage a securing aperture defined in the shaft lining shield so as temporarily secure the shaft lining shield relative to the shaft lining platform.

12. The boring system of claim 6, wherein a plurality of retractable actuating cylinders are provided around the shaft lining platform and adjacent the shaft lining shield to support the lining segments as they are placed against the side wall of the bored hole so that the shaft lining shield is temporarily positioned between the lining segments and the side wall, the shaft lining shield comprising a plurality of shield segments that can be displayed radially as the lining segments are pressed against the upper portion of the shield segments during installation to enable the shield segments to be pressed up right against the side wall.

13. The boring system of claim 6, wherein the segment fitting arm extends from a hydraulic cylinder mounted on or proximate the shaft lining platform and is arranged to move between various retracted and extended positions to retrieve the lining segments from the lining segment carrier device and to secure them against the side wall of the bored hole, the lining segments comprising a plurality of curved primary lining segments, a pair of end lining segments, and a locking lining segment for insertion between the pair of end lining segments to define a ring of lining segments.

14. The boring system of claim 1, wherein each wing includes a base wing portion and a movable end wing portion that is movable relative to the base wing portion, with a first actuator being operable to move the end wing portion relative to the base wing portion, the end wing portion being movable between an extended position in which the end wing portion extends substantially in line with the base wing portion, and a retracted position in which the end wing portion is moved upwardly relative to the base wing portion, to ultimately facilitate removal of the shaft enlargement arrangement from the bored hole.

15. The boring system of claim 14, wherein additional wing portions can be fitted between the base wing portion and the end wing portion to enable the length of the wings to be varied, thereby allowing relatively bigger holes to be bored by increasing the overall diameter of the winged arrangement.

16. The boring system of claim 1, wherein lowermost portions of the first cutter head include scrapers to scrape the cuttings into the lower collecting bunker as the first cutter head rotates relative to the column.

17. The boring system of claim 1, wherein the gripper arrangement is fitted to a gripper-moving actuator arrangement that is secured to the column, the gripper-moving actuator arrangement being operable to move the gripper arrangement axially along the length of the column.

18. The boring system of claim 1, wherein a stabilizing arrangement is provided to assist the gripper arrangement by first centering the shaft enlargement arrangement, the stabilizing arrangement including a plurality of radially spaced upper stabilizing shields above the gripper arrangement and a pair of radially spaced lower stabilizing shields below the gripper arrangement; and wherein a protective shield arrangement extends from below the first cutter head and adjacent the lower collecting bunker to the end of the boring head arrangement, the protective shield arrangement defining windows or apertures to accommodate the clamps of the gripper arrangement, and the upper and lower stabilizing shields of the stabilizing arrangement.

19. A boring system including a shaft enlargement arrangement, the shaft enlargement arrangement comprising:

a hollow column proximate a lower end of the boring system;

a first cutter head that is rotatably fitted to the hollow column, with first drive means being provided to rotate the first cutter head relative to the hollow column so as to bore downwardly a hole having a diameter corresponding substantially to the diameter of the first cutter head, the first cutter head comprising a support body carrying a winged arrangement, the support body being rotatably fitted to the column, the winged arrangement comprising a plurality of wings extending from the support body, each wing being fitted with, or comprising, a plurality of first cutter elements, each wing being angled upwardly and away from the support body so to define a substantially V-shaped cutting profile;

a boring head arrangement fitted to an operatively lower end of the column, the boring head arrangement terminating in a second cutter head, with second drive means being provided to drive the second cutter head so as to bore a leading hole as the boring system proceeds to bore downwardly; and a gripper arrangement fitted to the hollow column, the gripper arrangement being arranged around the column so as to substantially enclose the column, the gripper arrangement being positioned, in use, below the first cutter head and above the boring head arrangement, the gripper arrangement being arranged to securely grip against the leading hole bored by the second cutter head so as to secure the boring system in position within the bored hole, the gripper arrangement being fitted to a gripper-moving actuator arrangement secured to the column, the gripper-moving actuator arrangement being operable to move the gripper arrangement axially along the length of the column to assist in an overall downward movement of the shaft enlargement arrangement.

20. The boring system of claim 19, wherein the boring head arrangement is fitted to a flange secured to the operatively lower end of the column, with a boring head being fitted to the flange with a boring head-moving actuator arrangement, the boring head-moving actuator arrangement being operable to extend and retract the boring head relative to the flange to facilitate the boring of the leading hole as the boring system proceeds to bore downwardly, and wherein the boring head-moving actuator arrangement comprises a plurality of pairs of thrust cylinders, with each pair forming a V-shape arrangement to exert a thrust force on the boring head.

* * * * *